United States Patent [19]

Fröhlich

[11] 4,149,569

[45] * Apr. 17, 1979

[54] PROCESS AND APPARATUS FOR THE MANUFACTURE OF SLIDE FASTENERS

[75] Inventor: Alfons Fröhlich, Essen, Fed. Rep. of Germany

[73] Assignee: Opti Patent-, Forschungs- und Fabrikations-AG, Glarus, Switzerland

[ * ] Notice: The portion of the term of this patent subsequent to Jan. 11, 1995, has been disclaimed.

[21] Appl. No.: 831,994

[22] Filed: Sep. 9, 1977

Related U.S. Application Data

[63] Continuation-in-part of Ser. No. 722,265, Sep. 10, 1976, Pat. No. 4,098,229, and Ser. No. 722,239, Sep. 10, 1976, Pat. No. 4,078,585.

[30] Foreign Application Priority Data

Sep. 10, 1975 [DE] Fed. Rep. of Germany ..... 2540190
Sep. 10, 1975 [DE] Fed. Rep. of Germany ..... 2540238
Sep. 10, 1975 [DE] Fed. Rep. of Germany ..... 2540272

[51] Int. Cl.[2] ..... D03D 1/00; D03D 47/06

[52] U.S. Cl. ..... 139/11; 139/116; 29/33.2; 29/34 A; 24/205.16 C

[58] Field of Search ..... 139/46, 116.6, 11, 35, 139/116, 442, 384 B; 24/205.13 C, 205.16 C; 29/33 S, 33.2, 34 A

[56] References Cited

U.S. PATENT DOCUMENTS

| | | | |
|---|---|---|---|
| 3,123,103 | 3/1964 | Hendley | 139/11 |
| 3,249,126 | 5/1966 | Gerlach et al. | 139/384 B |
| 3,258,034 | 6/1966 | Gerlach | 139/11 |
| 3,688,805 | 9/1972 | Moertel | 139/11 |
| 3,847,188 | 11/1974 | Auer et al. | 139/116 |
| 3,880,203 | 4/1975 | Frohlich | 139/384 B |
| 3,945,407 | 3/1976 | Jakob | 139/384 B |
| 3,991,795 | 11/1976 | Bainer | 24/205.16 C |

FOREIGN PATENT DOCUMENTS

| | | | |
|---|---|---|---|
| 1022981 | 1/1958 | Fed. Rep. of Germany | 139/384 B |

*Primary Examiner*—Henry Jaudon
*Attorney, Agent, or Firm*—Karl F. Ross

[57] ABSTRACT

A weaving process and apparatus for producing a slide fastener from two continuous plastic filaments (synthetic-resin monofilament), each with a multiplicity of generally helicoidal coupling elements for interlocking with the coupling elements of the opposite filament, each filament being woven integral with the threads of its respective support tape to form a tape-like unit. Each coupling element has a coupling head on a loop and a pair of shanks terminating in bight portions which connect elements of the same tape-like unit. The shanks of each coupling element, which separate the bights from the loops, are held in close abutment by warp threads, with or without weft threads which pass over and under the successive paired abutting shanks of adjacent elements. Even stronger bracing can be obtained with bulbous projections on the shanks and bights, and by extending the coupling elements the entire width of the tape-like unit, replacing all or part of the weft threads. Thus the shanks can extend transversely to the warp over a substantial part or all of the tape-like unit to form the exclusive weft over this part or the entire width of the tape.

14 Claims, 59 Drawing Figures

119
103
106
106
5
111
116
116
105g
108
109
105b
105a
105d
105e
105d
105c
105c
105f
101
107
107
120

404
405
407
408
409
410
411
412
401
403
406
XIII

XLVII
XLVII
404
405
420
407
424
423
422
421
408
411
420
407
405
405
405
412
403
403

401
402
403
404
404a
405
406
407
408
410
411
16
17
9
XVII
XVIII
XIX

PROCESS AND APPARATUS FOR THE MANUFACTURE OF SLIDE FASTENERS

CROSS REFERENCE TO RELATED APPLICATIONS

This application is a continuation in part of my commonly assigned copending applications Ser. No. 722,265 (U.S. Pat. No. 4,098,229) and Ser. No. 722,339 (U.S. Pat. No. 4,078,585) and also discloses subject matter which was contributed by me to applications Ser. No. 722,048 (U.S. Pat. No. 4,099,302) and Ser. No. 722,047 (U.S. Pat. No. 4,084,297), all filed Sept. 10, 1976. This application also relates to Ser. No. 755,592 which was filed Dec. 30, 1976 as a division of Ser. No. 722,339 (U.S. Pat. 4,078,585).

FIELD OF THE INVENTION

My present invention relates to an apparatus and to a process for making a tape-like unit for a slide-fastener half and, more generally, to the fabrication of slide fasteners of the monofilament coupling element type.

BACKGROUND OF THE INVENTION

Known slide fasteners comprise a multiplicity of coupling elements formed from a pair of plastic filaments in a helix or meander attached to a pair of confronting support tapes, usually by chain stitches or warp threads. A slider interlocks the coupling elements on the confronting edges. Since the tape is made independently of the coupling elements, allowance must be left for sewing on of the filaments. At present, either the tape is made of a continuous pattern of weft and warp threads, or gaps are left in the pattern to be filled in when the element-attaching threads are added.

The resulting fastener has coupling elements with spaced-apart, shank portions, leaving room for the attaching threads or the weft. This arrangement lacks stability, since the properties of the fabric and threads affect the alignment of the coupling elements. Stretching or shrinking can occur due to moisture absorption, applied stress, washing or dry cleaning. The bights which connect the coupling elements cannot stabilize these forces, especially since spiral elements have large portions which are free of attaching threads. All these problems are most significant in the very thin plastic filaments commonly employed in the dress industry.

Present slide fastener manufacturing processes and apparatus can apply relatively few coupling elements to a given number of warp threads. Automatic warp needles avoid this limitation, but are able to produce slide fastener halves necessitating a multi-stage process.

More specifically, the common helical-coil slide fastener comprises a helix of thermoplastic synthetic-resin monofilament which can form along one side of the helix a multiplicity of coupling elements or heads which are slightly deformed parallel to the axis of the helix so as to interfit or interdigitate with the coupling head of another such coil on the confronting slide fastener half. The coupling head of each turn of the helix is connected by a pair of relatively short shanks to bight portions or bends opposite the coupling head to the shanks of successive turns of the helix. The helix can be somewhat flattened so as to have an elliptical profile as seen along the axis of the helix and the space between each bight and its coupling head is the minimum required to effect coiling of the monofilament.

When such a helix is applied to a woven textile tape, it can receive a filler cord and chain stitching can pass over the shanks and between successive shanks which are spaced apart in accordance with the pitch of the helix to secure the helix to the support tape.

As noted previously it is also possible to "weave" the helix into the support tape directly in which case a loop of at least one and possibly more weft threads passes between each turn of the helix which lies in the manner of a warp within the tape, the coupling heads projecting along an edge of the latter.

There is, therefore, a minimal spacing between each coupling head and the respective bight and a transverse spacing between the successive shanks, even of a single coupling head, which is equal substantially to the pitch of the helix and hence the center-to-center spacing of the coupling heads. Of course, the pitch at any given time is dependent upon the physical parameters of the threads which pass between the shanks, whether these threads are the chain-stitching threads or the weft threads which hold the helix in place. The pitch is not, for the most part, completely stable since the spacing between the coupling elements is determined by the textile material interposed between them as noted immediately above. With shrinkage, e.g. resulting from the action of moisture, or stretching (the application of stress), by the effect of heat and like environmental phenomena, the textile material between the coupling elements varies in dimension and the interelement spacing can vary along the coil or can vary between the two coils. This can interfere with opening and closing of the slide fastener and furthermore limits the closeness with which the coupling elements can be spaced because the minimum spacing is determined by the textile material interposed between these elements.

OBJECT OF THE INVENTION

It is therefore an object of my present invention to provide a method of and an apparatus for making improved slide fasteners of the above-described general type.

Another object is to provide a method of and an apparatus for producing economically a slide fastener of more stable construction.

Yet a further object of the invention is to provide an apparatus and process for making a slide fastener which extends the principles of the aforementioned copending applications.

It is also an object of the invention to provide an improved method of and apparatus for making slide-fastener halves.

SUMMARY OF THE INVENTION

The present invention provides a slide fastener in which the spacing of the coupling elements from one another is no longer dependent upon the type of anchoring system which is used for securing the coil to the supporting structure or tape because of the use of a novel technique whereby the coil is elongated transverse to its longitudinal axis so that the space between each bight and the respective coupling head is a multiple of the spacing previously encountered and indeed can be sufficient to allow the shanks to act at least in part as the exclusive weft over at least a portion of the support structure for the coupling heads.

An important feature of the invention is that each pair of shanks running to a coupling head of the present invention are extended transverse to the warp of the tape-like unit into which the coupling coil is woven so as to receive between each coupling head and the respective bight a plurality of warp threads which pass either over or under this pair of shanks which lie in mutually and directly abutting relationship so that neither warp threads, with which the shanks are interwoven, nor any additional weft threads which may be applied nor any stitching threads pass between the shanks of each pair.

According to another essential feature of the invention, each coupling element is formed as a loop or eye segment in the region in which it acts as a coupling head and interdigitates with the coupling heads of the opposite coil with the shanks to their junctions with this loop lying in a plane perpendicular to the axis of the coil and to the plane of the slide fastener so that the shanks in these junction regions have coinciding projections upon the slide fastener plane, i.e. cover one another in such projection.

However, directly following these transition or junction regions and running perpendicularly to the warp away from each coupling head, loop or eye, the shanks of each pair are caused to lie in mutually abutting relationship against one another in a plane parallel to the axis of the coil and the plane of the slide fastener.

Thus each pair of shanks, lying in such mutually abutting relationship acts as a double-filament weft interwoven with the warp threads over the width of the tape-like unit along which the coil extends. Of course, where the length of the shanks is substantially equal to the width of the tape, no additional weft is required and the paired shanks function as the sole weft for the tapes. On the other hand, where the tape-like unit is formed integrally with an edge of the tape, extending over a span of a multiplicity of warp threads, an additional weft can be provided for the balance of the tape, the additional weft being looped about the bights of the turns of the coil.

I have used the term "coil" herein in its most general sense and it will be apparent that the same principle applies to true helices, in which the coupling elements are formed by continuous turns, or to meanders. The warp threads pass over and under the paired abutting shanks to form therewith a particularly firm support structure. However, the shanks can form the weft also of a weft-inlay warp-knit fabric, each pair of shanks lying in a respective course of the knit.

More specifically, these objects are attained according to my present invention in a slide fastener in which a pair of continuous flexible synthetic-resin monofilaments are formed with a multiplicity of coupling elements interconnectable along confronting edges by movement of a slider thereon. Each coupling element has a loop end with a coupling head, a pair of shanks extending from the loop end, and a bight portion connecting the shanks of adjacent elements. The shanks of each element are held in side-by-side relationship over the greater portion of their length by textile warp threads passing between adjacent elements, with the warp threads and the coupling elements being woven in an integral tape-like unit.

Such a slide fastener, having coupling elements generally transverse to the warp with shanks in side-by-side (abutting) relationship over the greater portion of their length and in vertically-superposed relationship for a lesser portion of its length, is self-bracing and therefore more stable in the face of external forces than those known in the art. Strength can even be increased by adding bosses on the bight portions and on the shanks.

A slide fastener assembled from such tape-like units is not only simpler to produce and stronger in operation, but also presents a lower profile than the present helix-shaped coupling elements.

According to another feature of the invention, the slide fastener is provided with textile weft threads over all or part of the width of the tape-like unit, permitting a true textile tape to extend beyond the bights of the coupling elements. The weft threads can also brace the coupling elements by wrapping around the shank, neck or bight portions of the element in overloops. Most advantageously the ratio of overall length to shank diameter for the coupling element can vary between substantially 5:1 and 20:1, the shorter length applying to those with additional weft arrangements and having a preferred value of 8:1, the longer applies to those wherein the coupling elements replace separate weft threads completely and extend to and define the lateral boundaries of the tape-like units, having a preferred value of 13:1.

The slide fastener of the present invention can be a so-called "strip" fastener in which the usual support tape is not used so that the "strip" formed with the paired shanks as weft and warp threads extending the full length of the strip, can be stitched by conventional sewing techniques to a garment directly, or in which the coupling elements can be inserted into a garment. Alternatively, the slide fastener can be of the conventional tape type. In the first case, the bights lie along one edge of the tape-like support structure or strip and can form guide plates for the slider which can extend over the full width of the strip and another strip which can be joined to the first by movement of the slider along the coils to interconnect the coupling elements. In the second case, the tape can be stitched to the garment or to the support.

The advantage of the present system resides in the fact that the spacing of the coupling elements from one another is not affected by the characteristics of the anchoring structure. The entire coupling element strip is dimensionally determinate and stable because the shanks which connect the coupling elements directly abut one another and because the shanks are held in pairs by the warp without intervening of textile filament or threads between the shanks of the pairs. The paired shanks lie in pockets within the warp and are not susceptible to distortion which otherwise might affect the filaments. Changes in thickness of the warp have no effect on the pockets and even longitudinal stresses which could result in stretching of the warp do not change the relative positions of the pockets.

The positions of the bights are similarly stabilized and, in accordance with a feature of the invention, it is possible to make the shanks of different lengths so that bights are formed alternately at a relatively greater and lesser spacing from the coupling heads.

Furthermore, the formation of the shank pairs and their incorporation in respective pockets of the warp makes production of the slide fastener substantially simpler, especially when it is carried out on mechanical weaving looms or knitting machines since the coupling coil can be formed by needles the same as those used for the inlaying of double weft with the addition of a loop-forming mandrel to produce the coupling elements, eyes or heads. Thus the present invention also involves a special weaving process and an associated apparatus.

According to this aspect of the invention, two synthetic-resin monofilament threads are woven in the warp shed as weft threads by needles which pass into the warp shed from opposite sides thereof and lie as respective filaments around a common mandrel before leaving the shed. The warp is reshedded and the weft formed by inlayed monofilament is beaten up by the batten or reed so that the two weft passes through each warp pocket of the filament lie in mutually abutting relationship as a double weft.

The synthetic-resin monofilament can then be subjected to thermofixing, preferably at the mandrel.

As is known in connection with the fabrication of slide fasteners with synthetic-resin monofilaments, thermofixing is a heat treatment in which the applied shape of the coupling element and coil is stabilized, i.e. any resilient stress is relaxed.

The method can be carried out in a conventional tape-forming loom with the addition of the weft inlaying needles and a centrally disposed mandrel about which the coupling heads are formed. The mandrel may be carried by a raisable and lowerable mandrel holder operated in the cadence of operation of the weft needles to accommodate the inward and outward passes thereof. The coupling heads can be elongated eye-like loops or eyes lying in planes perpendicular to the plane of the slide fastener and having shanks extending away from the eye and merging therewith at transition regions whose projections on the latter plane coincide, the shanks being connected with the shanks of adjoining coupling elements of the row formed by each synthetic-resin monofilament by a respective bight or bight portion.

Each coupling element can thus have a relatively long shank which lies orthogonal to the warp or the longitudinal textile threads and extends over a substantial portion of the width of the tape, this long shank terminating in a distal bight which connects it to a long shank of the next coupling element. Each coupling element also has a short shank which can be inclined to the common axis of the eyes of each row and which terminates in a proximal bight connecting it to the short shank of an adjacent coupling element.

An important feature of the invention is that one shank running to a coupling head of the present invention is extended transverse to the warp of the tape-like unit into which the coupling coil is woven so as to receive between each coupling head and the respective bight a plurality of warp threads which pass either over or under this shank. Both shanks of each coupling element lie in mutually and directly abutting relationship in pairs so that neither the warp threads, with which the paired shanks are interwoven, nor any additional weft threads which may be applied, not any stitching threads pass between the shanks of each pair. Of course, where the length of one of the shanks is substantially equal to the width of the tape, no additional weft is required and this shank and the paired shanks function as the sole weft for the tapes. On the other hand, in this case and where the tape-like unit is formed integrally with an edge of the tape, extending over a span of a multiplicity of warp threads, an additional weft can be provided for the balance of the tape, the additional weft being looped about the bights of the short shanks of the coil or row.

The ratio of the lengths of the long and short shanks varies between substantially 1.5:1 and 5:1, with those values between 1.5:1 and 3:1 being most suitable for having overloops of the weft pass through the second (proximal) bight portion and then around the adjacent portion of the long shank. The ratio of the diameters of the short and long shanks, irrespective of their associated bosses, can vary between 1:2 and 2:1, with the preferred arrangement, however, being when they are about equal.

The longitudinal threads cross over from top to bottom in the tape-like structure between successive long shanks and in general it is desirable to provide a textile weft thread which is interwoven with additional warp or longitudinal threads and is looped around the bridge of proximal bight. It is also possible to loop at least on textile weft around the distal bights connecting the long shanks if desired.

A slider can be provided which, at its core or heart piece, has material-deflecting flanges which divert the edges of the garment or other article to which the slider fastener is attached away from the path of the slider, the slider being internally configured for a press fitting of the coupling elements together, i.e. the thrust of a coupling element between coupling elements of the other row in a direction transverse to the plane of the slide fastener.

The pressure-coupling slider comprises a pair of mutually parallel guide channels for the respective slide fastener strips, these channels running in the direction of the slide fastener longitudinal axis and having a tuning fork configuration in a projection parallel to the slide fastener plane and orthogonal to the longitudinal axis of the slide fastener, i.e. a projection in a plane perpendicular to the slide-fastening plane and including the axis. The tuning fork comprises a pair of parallel leg sections, a trunk section and inclined transition sections between each leg section and the trunk section. The divider formed as a connecting web disposed in the region of the leg sections and ahead of which the inclined transitions terminate.

The tuning fork configuration of the guide channels for the slide fastener strips makes it possible to so shape the connecting web that it has the characteristic described above. The feature whereby the connecting web terminates ahead of the inclined transition sections is advantageous in that the two parallel leg sections can feed the coupling rows on to one another and further that it allows with great ease the slider to be applied at one end of the stringer to the connected coupling strips. Of course this greatly facilitates application of the slider to the stringer which is advantageously fabricated in a closed condition. Moreover, the channels which accommodate the strips facilitate an easier and more reliable displacement of the slider so that the latter can be displaceable more rapidly and bring about faster opening and closing of the slide fastener without failure of missing of the interfitting of the coupling elements.

The term "spreadability" as its applies to the present invention is used to denote the ability to spread apart successive coupling heads of each row as seen in projections of the coupling heads upon the slide fastener plane. The spreading is effected by an arcuate guiding of the rows of coupling elements or strips in the channels of the slider.

According to an important feature, this spreading is limited to avoid distortion of the coupling elements by carrying out the interconnection by press fitting along the principles described but with slight spreading of the coupling element as viewed in projection on the slide fastener plane. The invention takes into consideration the fact that the tape-like unit or support structure renders the interhead spacing of the rows of coupling elements fully determinate under all conditions and independent from the sewing seams and stitching operation whereby the slide fastener strips are attached to the garment or other articles. Of course this clearly limits the spreadability and ensures that the coupling strips will assume their original positions even if they have been slightly deformed to provide a spreading as seen in projection upon the slide fastener plane. No difficulties arise, moreover, because the slider has two guide channels, each of which can accommodate the entire strip and the channels are designed to force the coupling heads of one row between the coupling heads of the other row in a direction transverse to the plane of the slide fastener and hence the planes of the two coupling strips. The fabric-deflecting flanks prevent the material to which the strips are attached from being entrained with the slide and disrupting the opening and closing movement thereof.

It is important to ensure that the slide fastener will accurately guide the slider and be received therein. In other words play between the slider and the coupling strips should be minimized. Accordingly the invention provides that the height of the guide channels of the slider should substantially coincide with the thickness of the coupling strips in the regions in which the coupling strips are enclosed by these channels. Moreover, the coupling eyes may be received in portions of the channel of substantially the same height and defined between the inner surface of the fabric-deflecting flanges and opposite side of the channels.

At the slider mouth the separation of the two strip channels is held as small as possible and preferably is only as great as the height of the coupling heads with respect to the slide fastener plane, i.e. this spacing is equal to the minimum necessary to ensure separation of the interdigitated coupling head. Of course, the slider must be able to accommodate the stitching thread which applies the respective strips to the article and, if provided with the configuration described above, can be readily fitted onto the strips when the latter are stitched in place. In the simplest case the slider may be formed between the lower flange and the fabric-deflecting flanges with a groove or channel within the stitching seams can pass.

According to a feature of the invention, in the region of the coupling heads and the coupling eyes, the long axis lies parallel to the slide fastener plane and hence to the confronting edges along which the rows can be interconnected. In the region of the bights which interconnect the shanks remote from the coupling heads, the long axis lies perpendicular to the plane of the slide fastener or, put another way, the short axis lies parallel to the slide fastener plane.

In regions between the coupling eyes and the bights, the connecting shanks have transition twists which permit the long axis to rotate through 90° between the eye and the bight, these transition twists being concentrated in the region of the eye, concentrated in the region of the bight, or extending uniformly over the length of the shanks.

In a preferred embodiment of the invention, the shanks of each coupling element are pressed into greater surface contact than is afforded by the applied ellipsoidal configuration for more effective abutting relationship and hence greater torque-resisting stiffness.

The coupling heads can be bulged outwardly at their ends lying parallel to the confronting edges of the slide fastener by buckling the ellipsoidal filament in the regions of the heads, the ellipsoidal configuration, the buckled heads end, if desired, buckled bights being set by a thermosfixing operation. The additional bedding of the shanks against one another can be made permanent by thermofixing as well or by hot-pressing the shanks together to accomplish simultaneously the additional deformation and the thermofixing process.

Best results are obtained with a ratio of the length of the short axis of the cross-section to the length of the long axis between 1:1.5 and 1:2.

Most surprisingly, by comparison with conventional coupling elements using circular-cross-section monofilament, the torsion strength of the slide fastener is greatly improved. Apparently this torsion strength is improved because of the fact that the polar moment of inertia continuously varies along the shanks, the bights are more resistant to bending stresses and the coupling heads are made more rigid in planes peripendicular to the slide fastener plane and the axis of the eye. While the coupling element retains flexibility sufficient to enable it to operate, e.g. with a slider of the type described above, the system is highly resistant to separation resulting from torsional stress.

The thermofixing can be carried out over the entire coupling elements and the coupling heads can be provided with any lateral formation simply by buckling as described. All that is necessary is that the normally circular monofilament be pressed prior to forming the coupling elements to impart the flattened or ellipsoidal cross-section thereto. This flattening can be such as to elongate the cross-section to a dimension greater than the long functional axis so that, upon thermofixing, the cross-section is brought into the ellipsoidal profile mentioned above.

The apparatus for making the coupling elements can include flattening rollers for shaping the porfile of the circular monofilament, followed by a forming station part of the loom in which the coupling elements are laid down, the forming station being disposed immediately ahead of a thermofixing station.

The process of the invention thus involves initially flattening the synthetic-resin monofilament, e.g between a pair of rollers, and without embossing or otherwise producing spaced-apart deformation therein, laying the strand to buckle it in forming the coupling head, twisting the strand through 90° along a shank, bending the strand to form the bight, twisting the strand again through 90° and repeating the process for each coupling element.

According to a preferred embodiment of the invention, the monofilament is cold-formed at a temperature below the vitreous transition temperature which is about 70° C. for polyethyleneterephthalate and about 30° C. for polybutyleneterephthalate and polyamide. Below this glass transition point there is no molecular movement upon deformation in the monofilament so that the cross-sectional change is relatively reversible. The long and short axes are altered by about 10 to 25% during the subsequent thermofixing which may be carried out by means of heat or ultrasonics.

The starting material is preferably synthetic-resin monofilament of circular cross-section (polyamide or polyester) which has been stretched in a stretching ratio of 1:3.5 to 1:5.

An advantage of this aspect of the invention resides in the fact that the formation of singular embossed location spaced along the strand or filament are eliminated so that the monofilament is more readily and accurately shaped in the loom or other machine.

BRIEF DESCRIPTION OF THE DRAWING

FIG. 57 is a cross-sectional view along the line LVI—LVI of FIG. 53.

SPECIFIC DESCRIPTION

Figure 2:
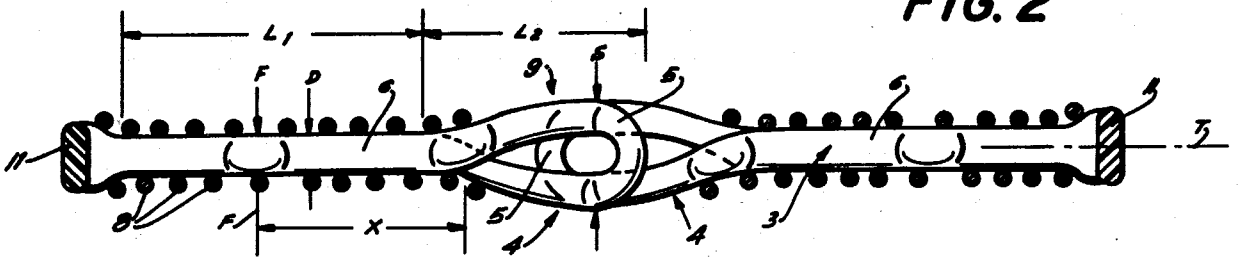
FIG. 2 is a cross-sectional view of the fastener of FIG. 1 taken along line II—II.
Figure 1:
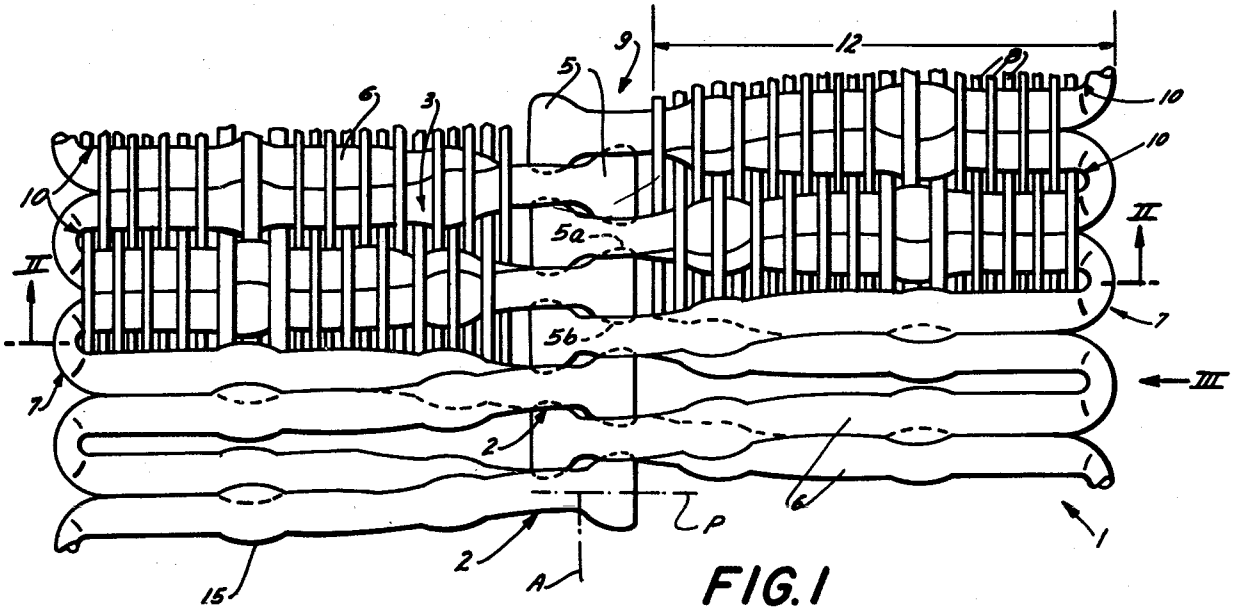
FIG. 1 is a diagrammatic plan view of a slide fastener according to my present invention.
Figure 3:
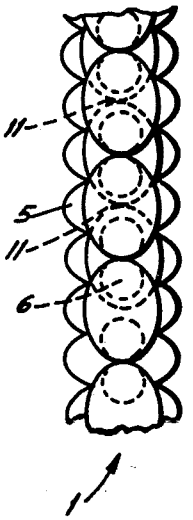
FIG. 3 is a side view of the fastener of FIG. 1 takein in the direction of arrow III.

As seen in FIGS. 1, 2 and 3, a strip-type tapeless slide fastener has a pair of interdigitated synthetic-resin monofilament coils 1 (e.g. of polyester or nylon). Each coil 1 has a mutliplicity of coupling elements 3, each comprising a loop end 4 with locking necks 2 and a locking head 5, a pair of shanks 6 lying in side-by-side relationship over the greater portion of their length, and a reversely bent bight portion 7 which connects adjacent elements 3.

Coupling elements 3 on opposite sides of a contact zone 9 are interlocked by their heads 5 and necks 2. Textile warp threads 8 form warp pockets 10 receiving the paired shanks 6 of adjacent elements 3, forming with the elements 3 a single tape-like unit 12 with the shanks 6 in side-by-side pairs replacing the usual weft threads. Edge bosses 11 on the bights 7 serve to define the spacing between the pockets 10 and to guide a slider (not shown), while shank bosses 15 aid bracing of the tape-like unit 12.

From FIGS. 1–3 it will also be apparent that the bosses 15 are formed laterally on the synthetic-resin monofilament strand 15 at distances X corresponding to half the loop lengths of the heads 5 so that, when these heads are formed around a mandrel, the bosses produce lateral projections 5*a* and 5*b* of the head which are received in the neck or transition portions 2 of the loops. The bosses may be formed, prior to inlaying of monofilaments in the warp sheds by plastically deforming the monofilament with a force as represented by the arrows F in FIG. 2.

In one preferred embodiment of length $L_2$ of the head loop 5 is smaller than the shank length $L_1$, i.e. $L_1$ is greater than $L_2$ and this can be found to be the case in all of the embodiments of the invention disclosed herein. The head loop 5 lies in a plane P perpendicular to the axis A of the heads and hence to the longitudinal axis of the coil formed by each monofilament. In FIG. 1, the plane of the paper can be considered to be the plane of the slide fastener and the plane P is perpendicular to the plane of the paper and to the slide fastener.

The length $L_1$ is a considerable multiple of the diameter D of the monofilament, preferably being between five and twenty times this diameter D. The system illustrated in FIGS. 1–3, moreover, has a monofilament extending the full width of the strip formed by the paired shanks 6 as the exclusive weft and warp threads 8. A considerable number of warp threads extend over and under the pairs of shanks between the bights 7 and the heads 5 and in all cases a multiplicity of such warp threads will overlie and underlie the paired chanks. At least five such warp threads should extend along the weft formed by the shanks. The bosses 15 in the region of the bights result in plate-like formation 11 at the latter to form ridges along which the slider (not shown) is guided. Over the major part of their length, i.e. at least over the region $L_1$, the shanks 6 lie in a plane T perpendicular to the plane of the paper in FIG. 2 and corresponding to the plane of the slide fastener mentioned earlier. The plane T is, of course, perpendicular to the plane P.

In the region 9 at which the coupling heads 5 interdigitate, the junctions 2 between the shanks 6 and the arcuate segment of each coupling head 5 lie one above the other so that their respective projections upon the plane coincide. Away from the coupling heads 5, the shanks 6 lie directly side-by-side in mutually abutting relationship in pairs within the common warp pockets 10. These considerations also apply to the embodiments of FIGS. 4–6 as well.

Figures 4, 5, 6:
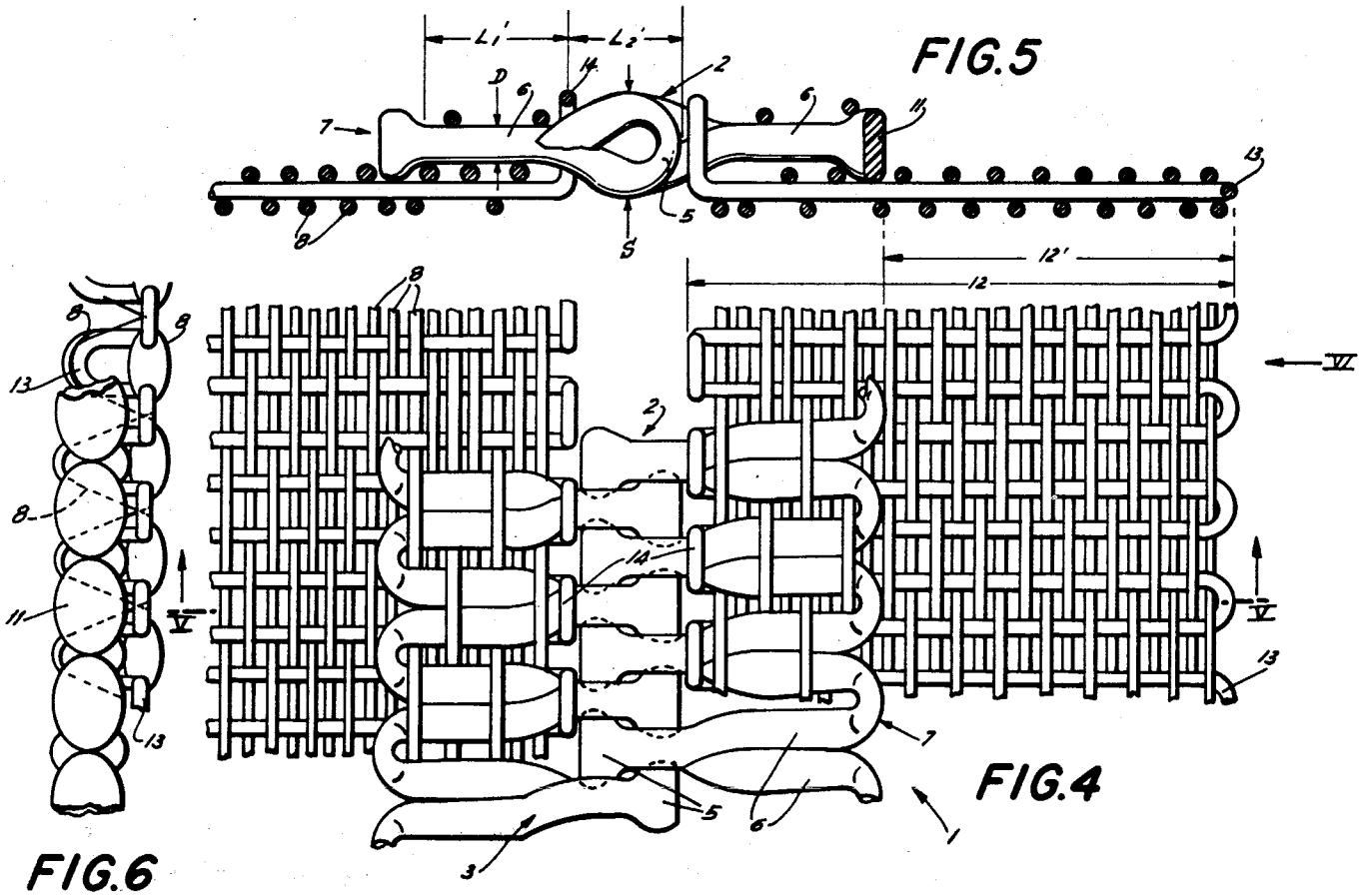
FIG. 4 is a diagrammatic plan view of another embodiment of my invention.
FIG. 5 is a cross-sectional view of the device of FIG. 4 taken along line V—V.
FIG. 6 is a side view of the device of FIG. 4 in the direction of arrow VI.

FIGS. 4, 5 and 6 show a tape-like unit 12 having a textile tape portion 12' with the weft fibers 13 as well as the warp fibers 8. The weft fibers 13 wrap around each coupling element 3 between the locking necks 2 and the shanks 6 in an overloop 14.

Figure 7:
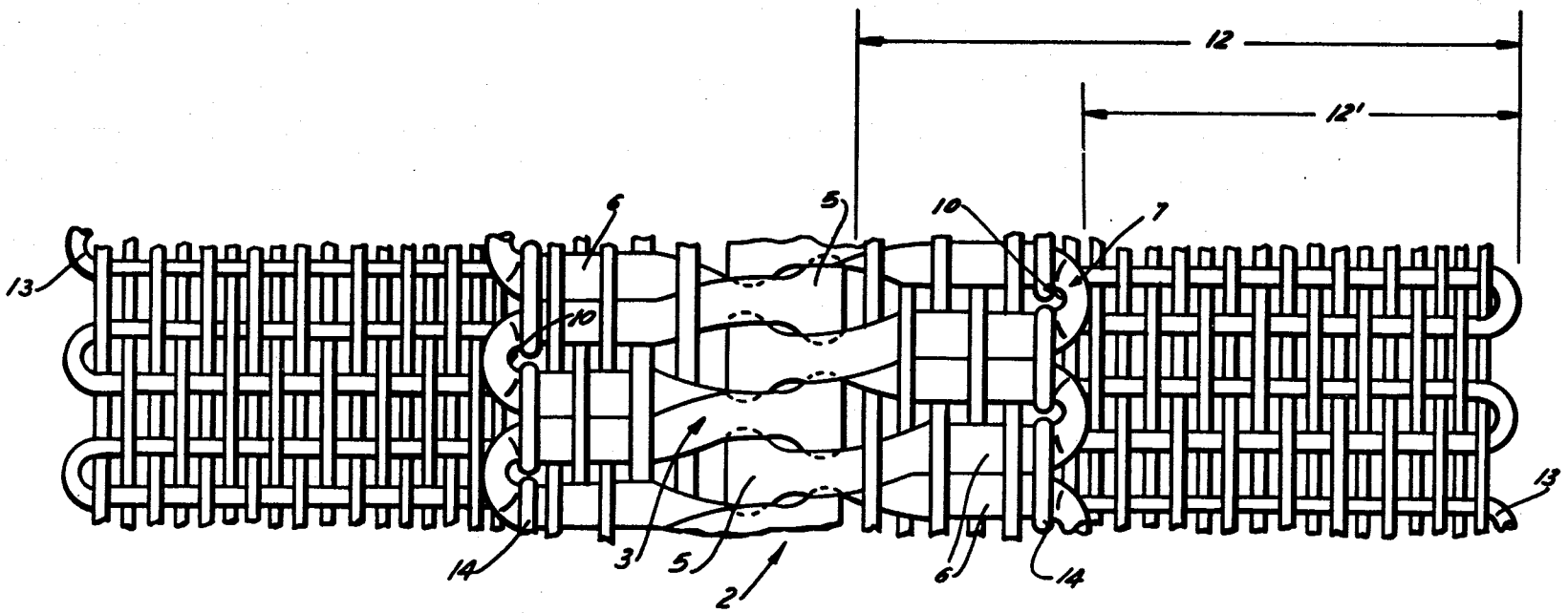
FIG. 7 is a diagrammatic plan view of still another embodiment of the invention.

FIG. 7 shows a tape-like unit 12 having a textile tape portion 12' with weft fibers 13 which wrap around the shanks 6 of the coupling elements 3 at the bights 7 in an overloop 14.

In the embodiments of FIGS. 1–7, the reversing bends or bights 7 form stabilizers for the spacing of the coupling heads and movement of the paired shanks 6 relative to one another is precluded. Since no textile threads lie between the shanks 6 of each pair, the interhead spacing is not affected by factors which have effected the stretching threads or weft filaments hitherto used by the successive shanks in conventional coupling elements.

Upon shrinkage of the longitudinal or warp threads 8 or thermal fixing of the slide fastener, the paired shanks 6 in the respective warp pockets 10 are uniformly stressed and variation in the interhead spacing does not occur.

While the longitudinal threads 8 are preferably constituted as the warp threads of a weave and cross over and under alternately the successive pairs of shanks 6, it will be understood that the longitudinal threads can also represent the loop forming threads of of a warp knit fabric in which the paired shanks are inlaid as a double knit weft.

The strips shown in FIGS. 1–3 and constituting respective slide-fastener halves directly, without separate tapes, can be affixed by stitching directly to garment parts or the like, the stitching being effected across the paired shanks 6 with the needle passing between them.

In the embodiment of FIGS. 4–7, the strip structure forms part of a tape which has a region 12 consisting exclusively of textile threads so that this portion 12' can be secured by stitching to the parts of the garment or the like.

In the embodiment of FIGS. 4–6 the shanks 6 are somewhat shorter although their lengths $L_1$ still exceed the lengths $L_2'$ of the heads 5. Advantageously, the head diameter S is the most equal to $L_2'$. The relationship between the length $L_1'$ and the diameter D can correspond to that originally described. In the embodiment of FIGS. 4–7, of course, the bights 7 may form guide plates 11 for the slider as previously described.

Figure 8:
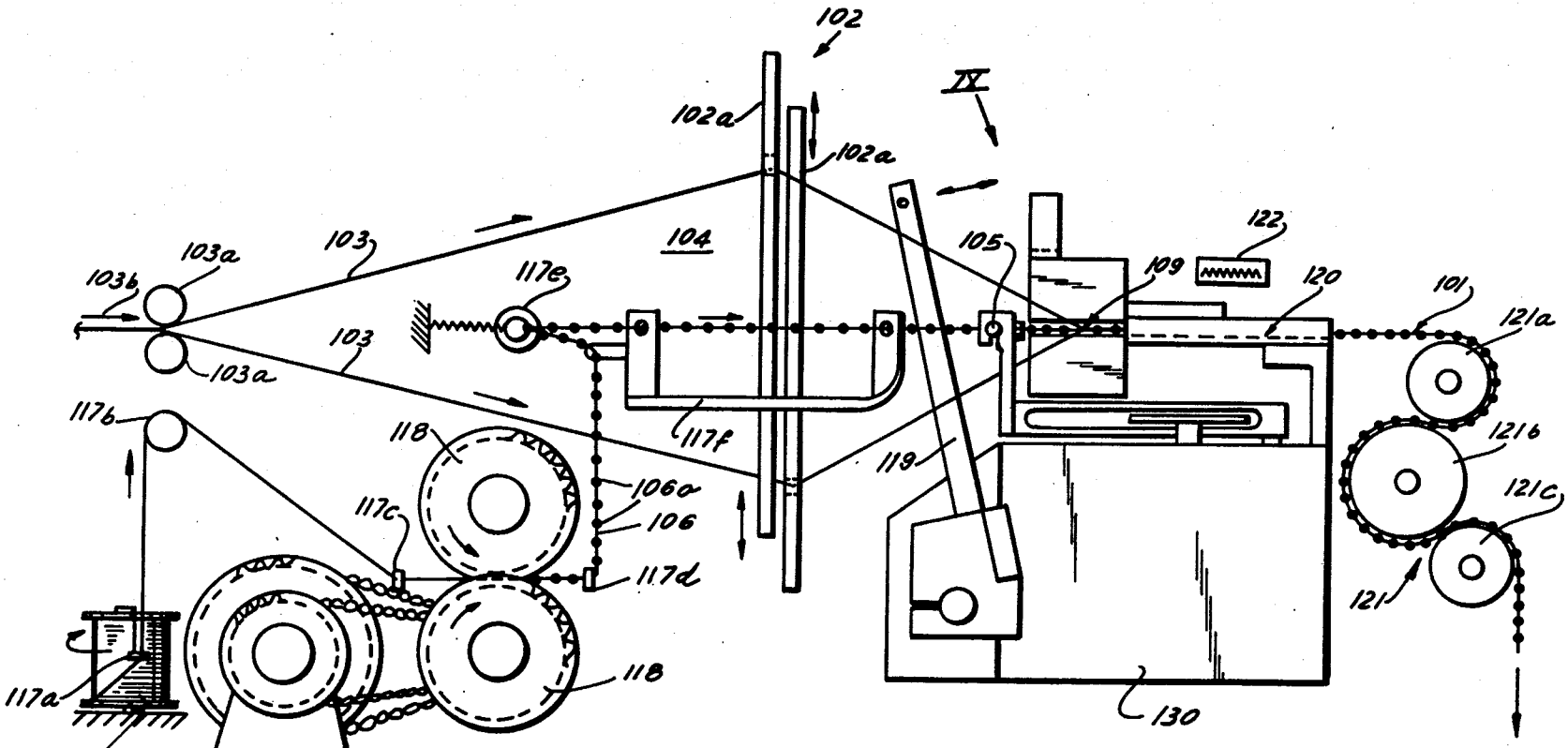
FIG. 8 is a diagrammatic side view of a slide fastener-making apparatus according to my present invention.
Figure 9:
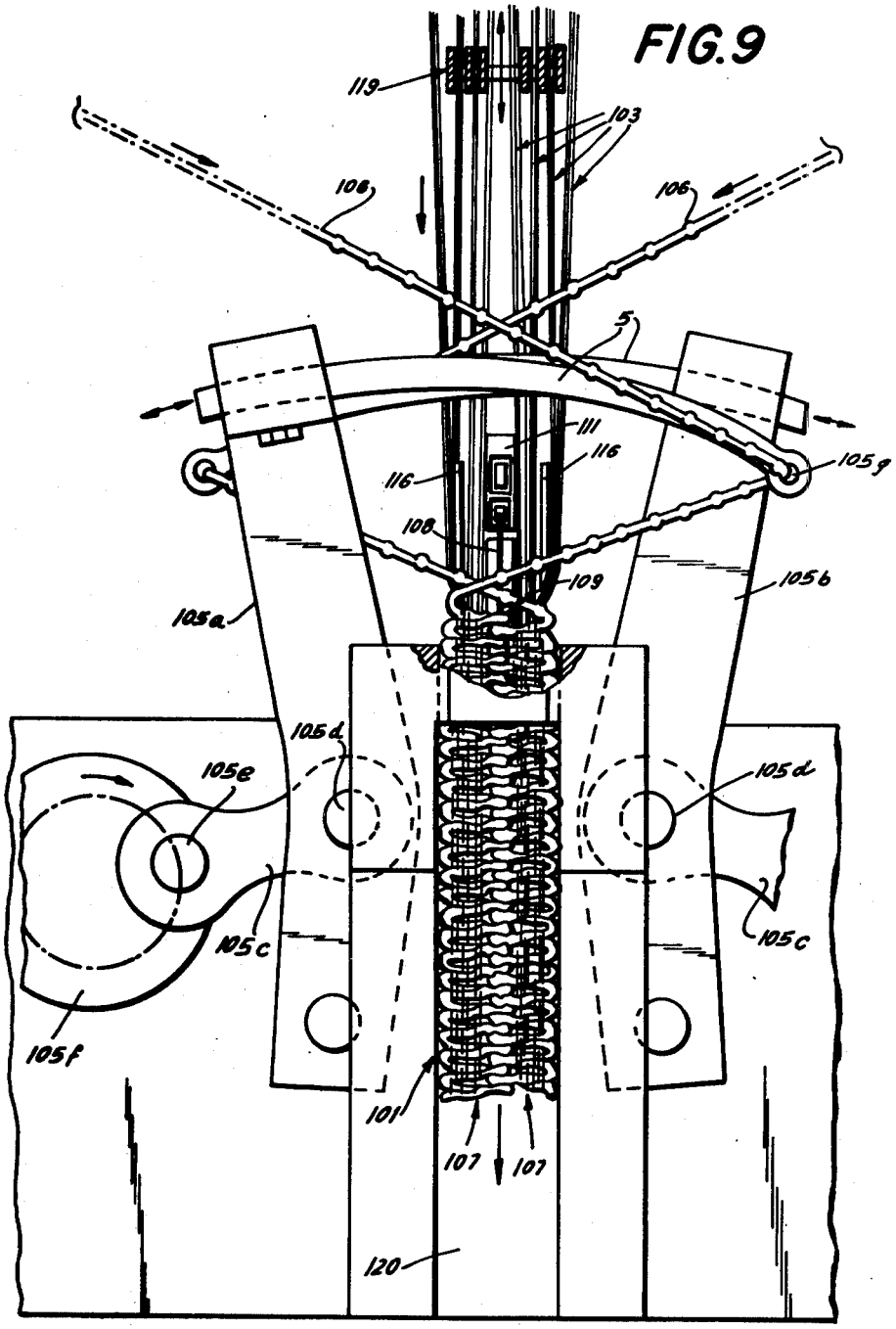
FIG. 9 is a plan view of a segment of FIG. 8 in the direction of arrow IX.

FIGS. 8, 9 illustrate the basic elements of the apparatus for fabricating the interdigitating strip slide fastener structures shown in FIGS. 1–3 and represented in FIGS. 8 and 9 at 101. Similar apparatuses can be used to form the strip fastener structures described below.

The apparatus comprises a warp-feed beam (not shown) from which the warp threads 103 are passed between a pair of rollers 103*a* in the direction of arrow 103*b*, the warp threads traversing respective heddles 102*a* of a harness 102 capable of forming a warp shed 104. As will be apparent from FIG. 9, the warp threads are divided into two groups and have a space between them.

From each side of the loom, respective weft-inlaying needles 105 carry the respective synthetic-resin monofilaments 106 into and through the respective sheds. To this end, the needles 105 are carried by arms 105*a* and 105*b* driven by links 105*c* which are articulated to the arms 105*a*, 105*b* at pivots 105*d*. Each link is swingable on an eccentric pin 105*e* driven by a wheel 105*f* so that needles are swung alternately to the right and to the left through respective sheds. The needles are synchronized with the heddle control (not shown) which can be of the usual tape-weaving type, and with the batten or reed 119 which is swingable, as can be seen in FIG. 8, to beat up the weft as it is led into the shed. Guides 116 engage the filaments to form the bights remote from the heads and prevent the weft inlaying from pulling the warp 103 inwardly.

As is also apparent from FIG. 8, the monofilament 106 is drawn from a spool 117 through a travelling eye 117*a* and passes over a guide roller 117*b* and between a pair of eyes 117*c* and 117*d* between a pair of embossing rollers 118 which can be heated ultrasonically or otherwise to form the bosses 106*a* (corresponding to the bosses 15 of FIGS. 1–3), therein. The embossed monofilament is then passed through a spring loaded eye 117*e* and a guide 117*f* to the eyelets 105*g* of the respective weft-inlay needle. The loom housing 130 is formed with a channel 120 through which the interlocking coupling elements are guided on to a takeoff unit 121 comprising a plurality of rollers 121*a*, 121*b* and 121*c* which frictionally engage the strip and reversely bend to facilitate variation of the strip. A thermofixing device in the form of a heater as represented at 122 above the guide 120 can be provided and, as will become apparent hereinafter, the bending mandrel 108 can also be extended into a heated portion which effects thermofixing of the heads.

The flexible mandrel 108 is disposed centrally between the weft sheds 104 for the respective slide fastener halves and, at the end 110 of the mandrel turned away from the downstream end 109 of the weft shed, is mounted in a raisable and lowerable mandrel holder 111 slidably.

As can be seen from FIG. 9, the weft-inlaying needles 105 lie in horizontal planes disposed one above the other so that their filament-entraining ends can cross over in the shed 104.

The mandrel holder 111 is received in a centrally interrupted vertical guide 112 and can be shifted by a plunger arrangement 113 between its upper and lower positions in which it is retained by magnets 114.

Figures 11, 11A, 11B:
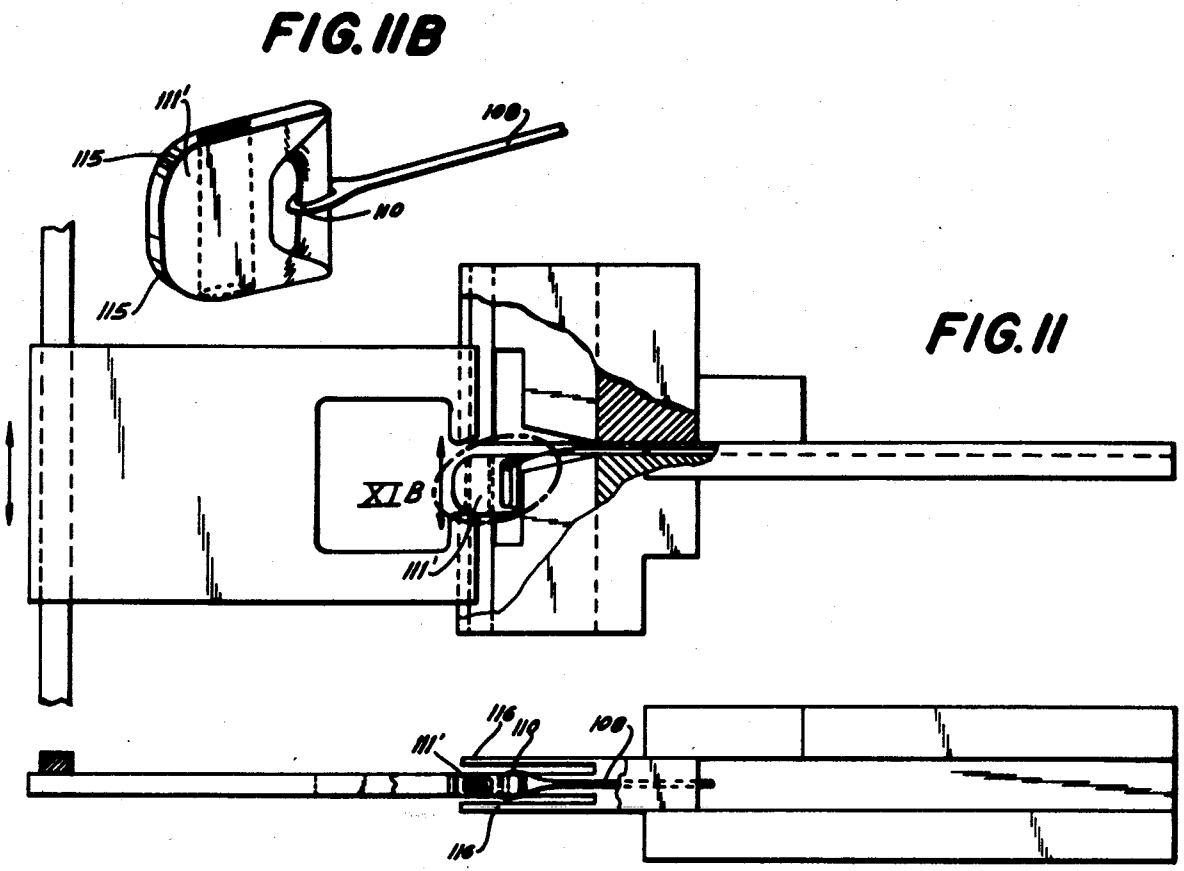
FIG. 11 is a diagrammatic side view, partly cut away, of another embodiment of the device of FIG. 10.
FIG. 11A is a plan view of the device of FIG. 11.
FIG. 11B is an isometric view of the area XIB of FIG. 11.

Of course, this holding arrangement 114 can be eliminated and the device can be constituted, as shown in FIG. 11, with rounded corners 115 of the mandrel holder 111′ so that it is cammed (FIGS. 11 and 11*a*) into its upper and lower positions.

The device illustrated in FIGS. 8 through 10 operates operates as follows:

Two supply spools 117 feed respective synthetic-resin monofilaments 106 through respective embossing roller pairs 118 to the respective weft needles. As can be seen from FIG. 9, the weft needles 105 lay the monofilament 106 into the warp shed across the lower set of warp threads and pass the mandrel 111. The mandrel 111 thereupon drops and the needles 105 withdraw the filament again across the lower threads of the shed. The harness actuated to reverse the shed and the weft is beaten up by the reed 119. Each shed, therefore, forms a pocket for a pair of mutually contacting shanks of the coupling elements. The process is repeated with the new shed and as many times as necessary to produce the desired length of slide fastener.

The length of the mandrel 108 is so selected that the coupling heads withdraw therefrom only after a considerable number of coupling heads are interdigitated by the needles. The mandrel can remain in place within the coupling heads until thermofixing has relaxed the stresses of the monofilament. Advantageously, the warp filaments are shrinkable and are subjected to a thermal shrinking operation to reduce their length by 10 to 15% to ensure a particularly tight grip of the shanks in the warp pockets.

The system has been described for the fabrication of a substantially coiled coupling element in which the coupling heads are generally wound around the mandrel. However, it was possible to provide the coupling elements 107 as U-shaped meander structure in which case the inlaying needles 105 are displayed directing the respective weft inlays so that one monofilament is brought over the other and vice versa in successive operations.

Figure 10:
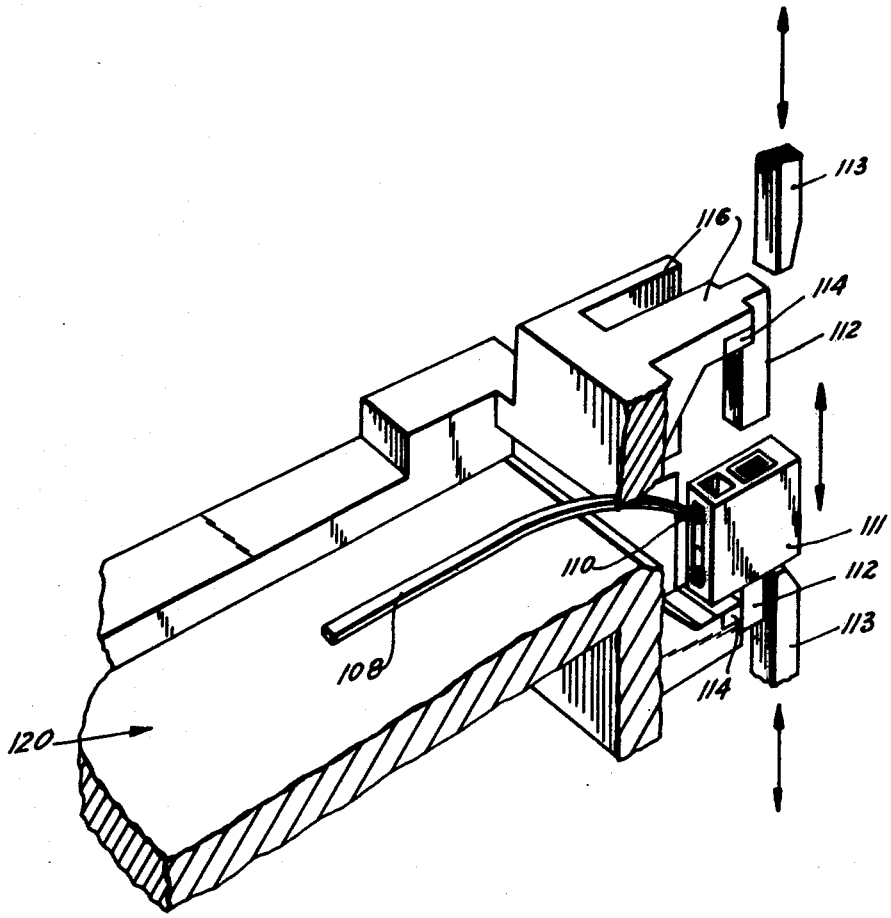
FIG. 10 is an isometric view of the apparatus of FIG. 9 partly cut away.
Figure 12:
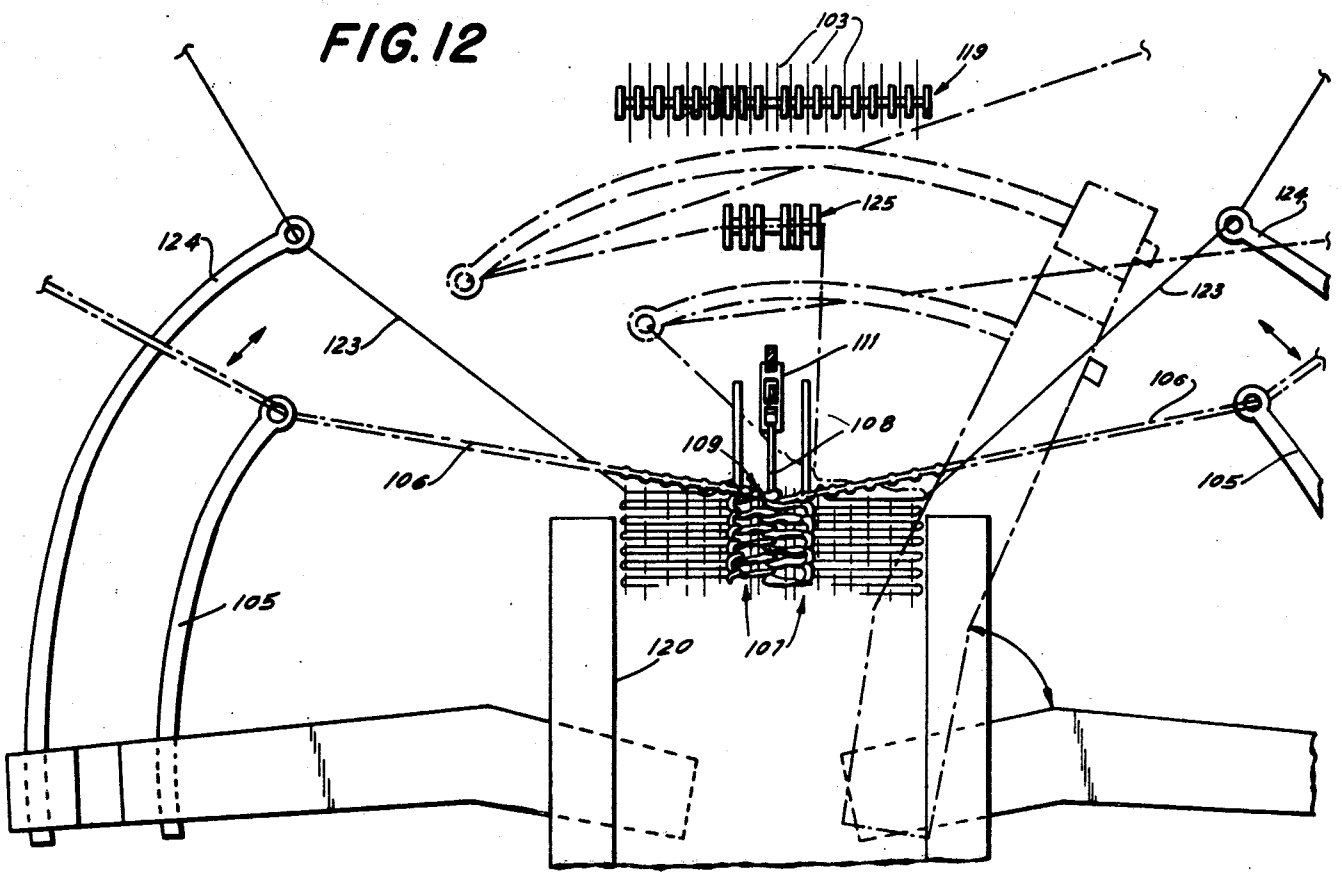
FIG. 12 is a diagrammatic plan view of a variation of the device of FIG. 9.
Figure 13:
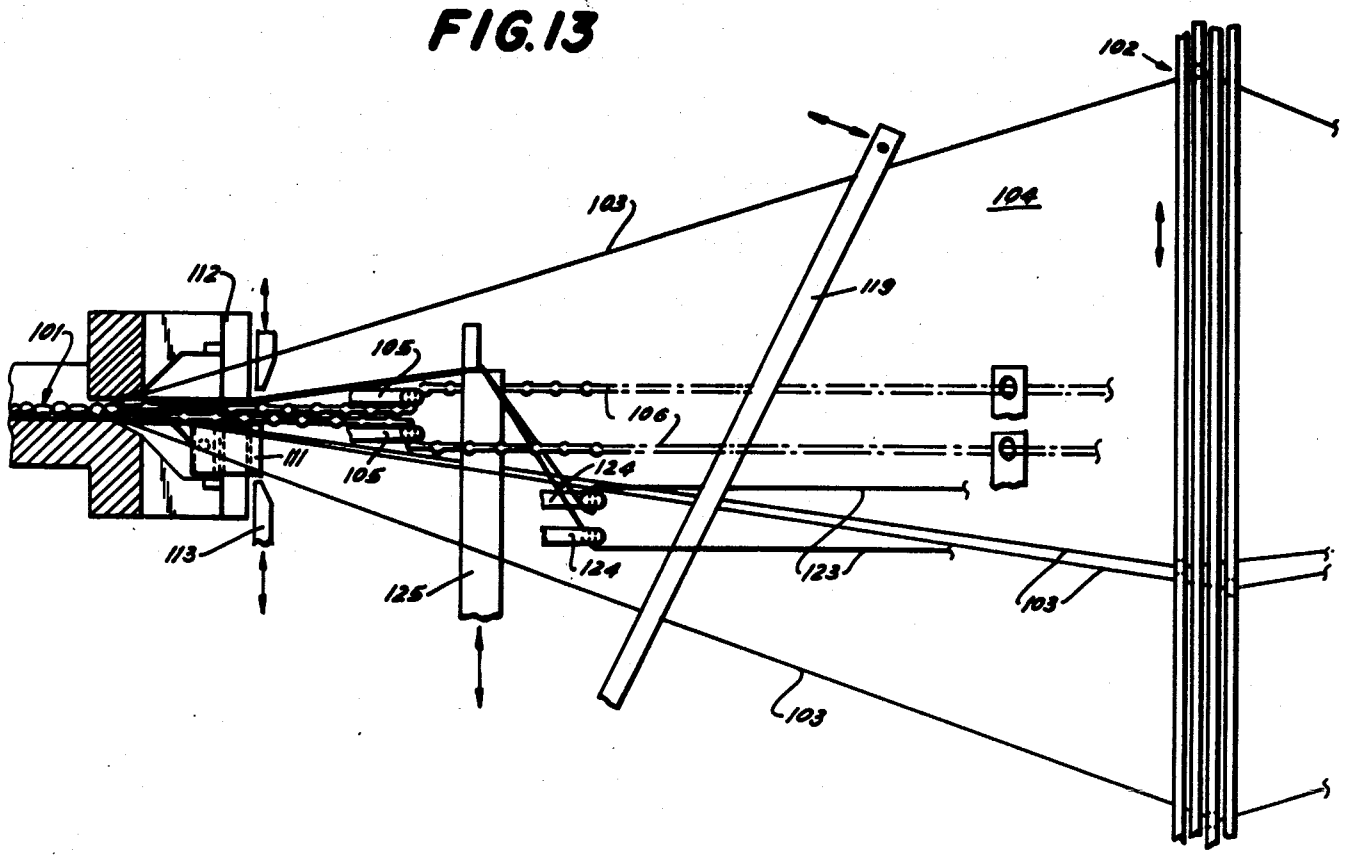
FIG. 13 is a diagrammatic view of the apparatus of FIG. 12.

The system illustrated in FIGS. 12 and 13 differs from that of FIGS. 8 through 10 only in that the weft needles carry, in addition to the weft needle 105 for the monofilaments, designed to coil the latter over only part of the width of the web (see FIG. 7), needles 124 which carry the additional weft threads 123 across the region 12′ of the tape to hook into the bights of the filament before they reach the mandrel 108. A weft thread lifter 125 is here provided to insure proper engagement of each bend of the monofilament with the textile thread weft. The remaining structure of course is the same as that of FIGS. 8 through 10 and a similar mode of operation prevails.

In subsequently described FIGURES, corresponding parts of the fasteners are identified by similar numerals in the 200, 300 etc. series.

Figure 15:
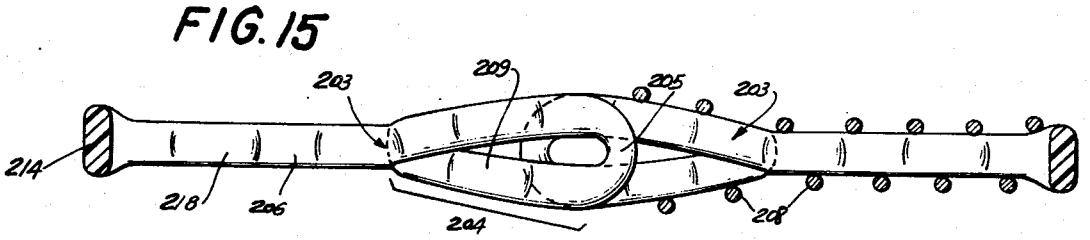
FIG. 15 is a cross-sectional view of the device of FIG. 14 taken along line XV—XV.
Figure 14:
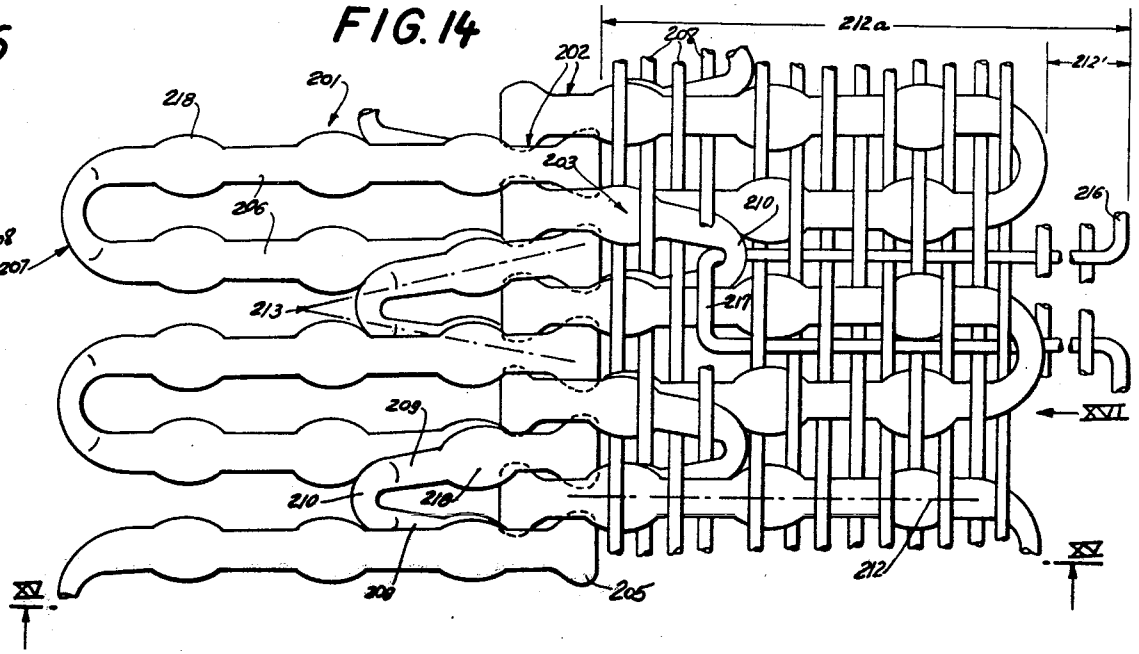
FIG. 14 is a diagrammatic plan view of another slide fastener which can be made by a process according to my invention.
Figure 16:
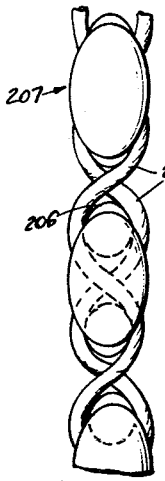
FIG. 16 is a side view of the device of FIG. 14. taken in the direction of arrow XVI of FIG. 14.

As seen in FIGS. 14–16, a slide fastener 201 has a multiplicity of coupling elements 203 comprising a coupling head 205 and locking necks 202 on a loop end 204, a long shank 206 and a short shank 209, with a first bight portion 207 connecting the long shank 206 with an adjacent long shank 206 and a second bight portion 210 connecting the short shank 209 with an adjacent short shank 209. Whereas the long shanks 206 are generally parallel to one another, the short shanks 209 diverge along a generally V-shaped path 213. Shanks 206 and 209 are provided with bosses 218 (flattenings parallel to the slide-fastener plane) and the first bight portions 207 have edge bosses 214. A multiplicity of parallel warp threads 208, running transverse to the long shanks 206, pass alternately over and under the coupling elements 203. A weft thread 216 interweaves with the warp threads 208 and bends around the coupling elements 203 in overloops 217 to form a tape-like unit 212*a* having a tape portion 212′ extending beyond the first bights 207.

Figure 18:
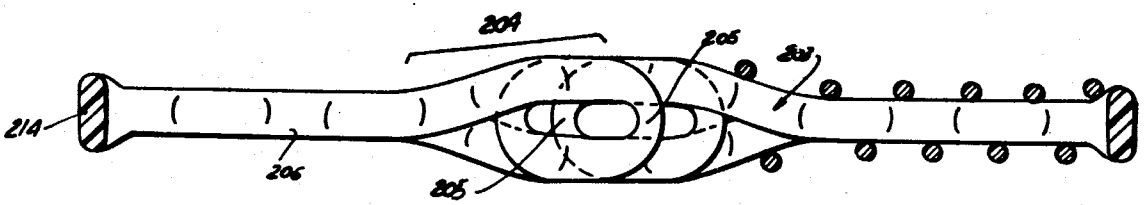
FIG. 18 is a cross-sectional view of the device of the fastener taken along line XVIII—XVIII.
Figure 17:
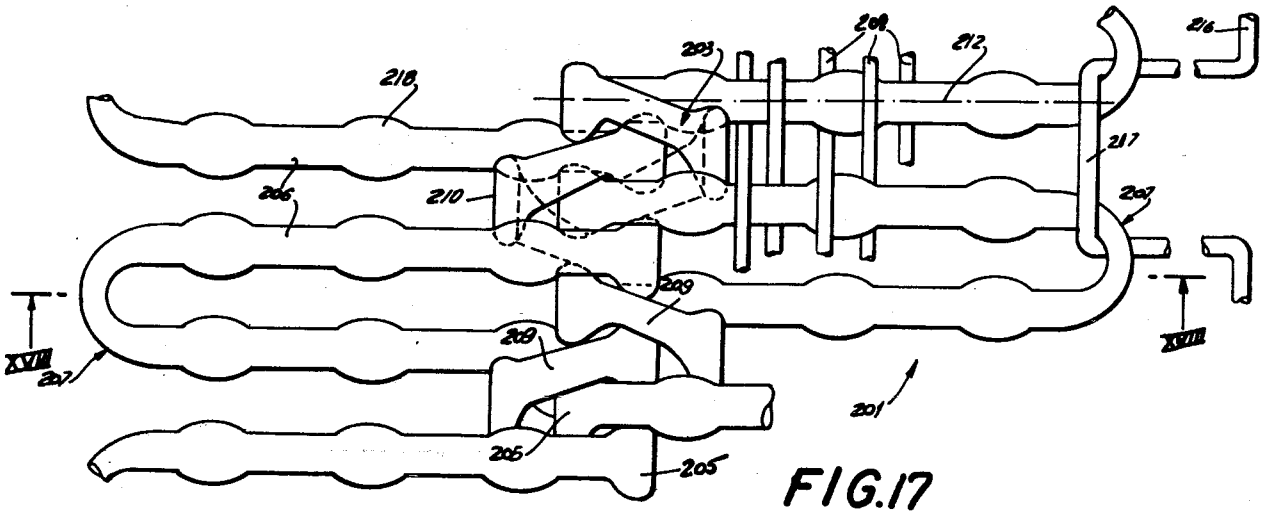
FIG. 17 is a diagrammatic plan view of another embodiment of such a slide fastener.

FIGS. 17 and 18 show a slide fastener 201 with coupling elements 203 having short shanks 209 forming short loops 219 shorter than the long loops 204 formed by the long shanks 206, with the second bight portions 210 having a similar profile to the edge bosses 214.

FIGS. 14 through 18 thus show a slide fastener in which each coupling row comprises a generally helical coil. This coil can be a true helix which is deformed or otherwise constituted with an elongated configuration.

The rows of coupling elements are composed of a synthetic-resin monofilament 201 and are formed with the coupling heads 202 whose coupling eyes 203 are constituted from eye-forming synthetic-resin monofilament segments 204, head formations 205 interfitting with the formations of the coupling elements of the other row, and connecting shanks 206.

The connecting shanks 206 (relatively long shanks) lie one after the other in a plane parallel to the slide fastener plane. They are interconnected by bights 207 and are locked in the tapelike unit by textile longitudinal threads (warp threads) 208. The coupling eyes 203 project laterally from the groups of weft threads 208.

In the embodiment of FIGS. 14 and 17, the slide fastener plane coincides with the plane of the drawing.

A comparison of the embodiment of FIGS. 14 through 16 with that of FIGS. 17 and 18 shows that one of the eye-forming synthetic-resin monofilament segments 204 of a coupling element is elongated to form the relatively long shank 206 while the other segment 204 is, immediately in the region of the eye 203, connected to the corresponding segment of an adjacent eye by a proximal bight or bridge portion 210. The bridge portions 210 are disposed immediately adjacent the coupling heads while the distal bights 207 are remote therefrom.

The extensions 209 of the proximal bights 210 intersect the slide fastener plane.

According to the invention, the connecting shanks 206 of the successive coupling elements lie in respective pockets 211 of the warp threads, the distal bights 207 extending from one of these pockets to the other.

The eye-forming segments 204 to which the long shanks 206 are connected, form straight lines in a projection on the slide fastener plane and with long shanks 206 as represented in FIGS. 14 and 204 by the broken line 212. The segments which run to the proximal bights 210 have projections on the slide fastener plane which form V's as represented at 213.

FIGS. 14 through 16 show clearly that the connecting portion 210 and the associated segments 204 are also received in pockets 211 of the warp threads. In this manner, this embodiment differs from that of FIGS. 17 and 18 in which the connection portions 210 and the associated segments 204 lie wholly outside the warp pockets 211. Both embodiments provide a support or tapelike structure in which the longitudinal threads 208 are constituted as warp threads of a weave in which the successive long shanks 206 extend orthogonal to the warp threads and constitute a weft. However, the longitudinal threads 208 can also represent loops of a warp knit fabric, in which case each shank 206 can lie in a respective course of the knit.

The left side of each of FIGS. 14 and 17 shows an arrangement in which the distal bights 207 can form an edge of the slide fastener so that these bights 207 form ridges upon which a slider is guided. At the right hand side of each of FIGS. 14 and 17, the coupling row and associated warp threads are to be part of a weave which is extended at 212'. The slide fastener then has the usual textile support tape 215 whereby it can be stitched to a garment or the like.

In the latter case, it is preferred to provide a textile weft thread 215 which is looped at 217 around the proximal bights 210.

It has also been found to be advantageous to subject the longitudinal threads 208 to a shrinkage treatment so that the shanks 206 are tightly bound in the pockets 211.

To improve the flexibility of the slide fastener, the shanks 206 can be provided with the aforementioned deformations 218 in the form of flattenings parallel to the slide fastener plane to increase the bendability of the system.

Figure 20:
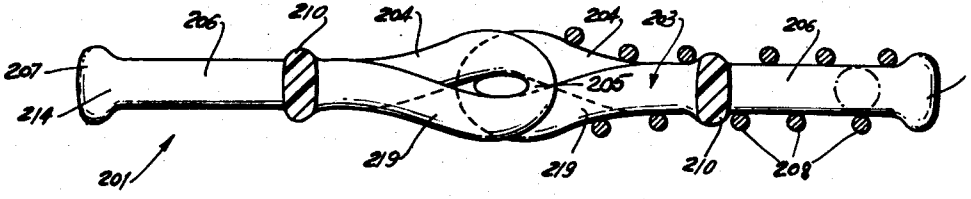
FIG. 20 is a cross-sectional view of the device of FIG. 19 taken along line X—X.
Figure 19:
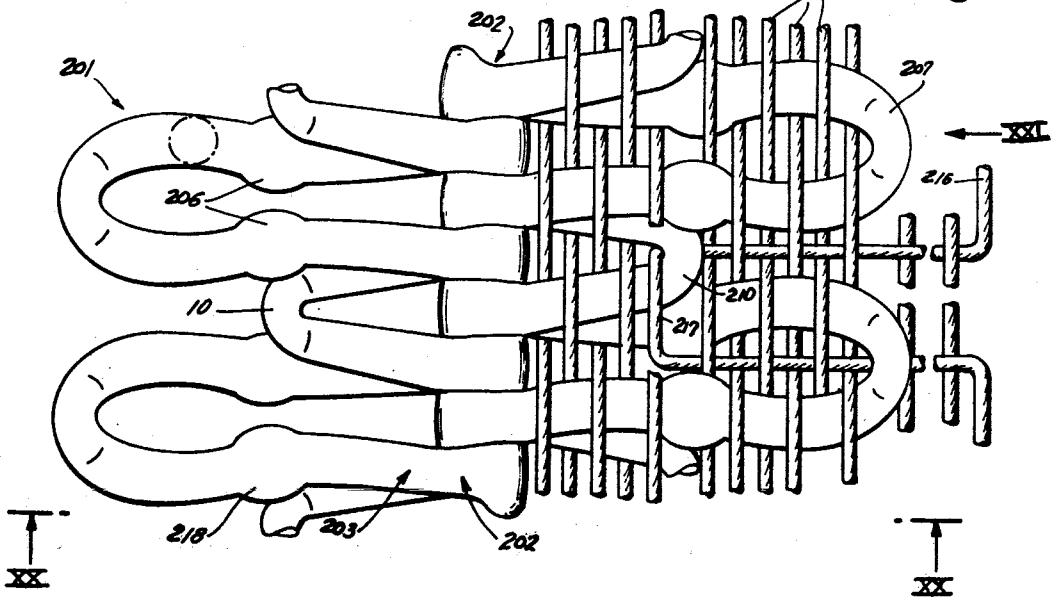
FIG. 19 is a diagrammatic plan view of another embodiment of the invention.
Figure 21:
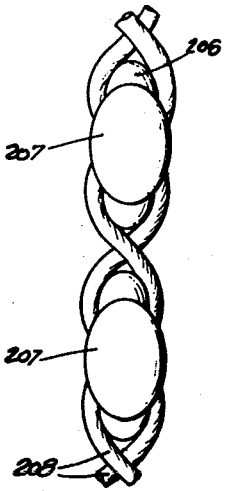
FIG. 21 is a side view of the device of FIG. 19 taken in the direction of arrow XI—XI.

FIGS. 19–21 show long shanks 206 and short shanks 209 of circular cross section, with the first bight portions 207 being bow-shaped and the second bight portions 210 being V-shaped. Loop ends 204 formed by the short and long shanks 209, 206 are equal in size.

Figure 22:
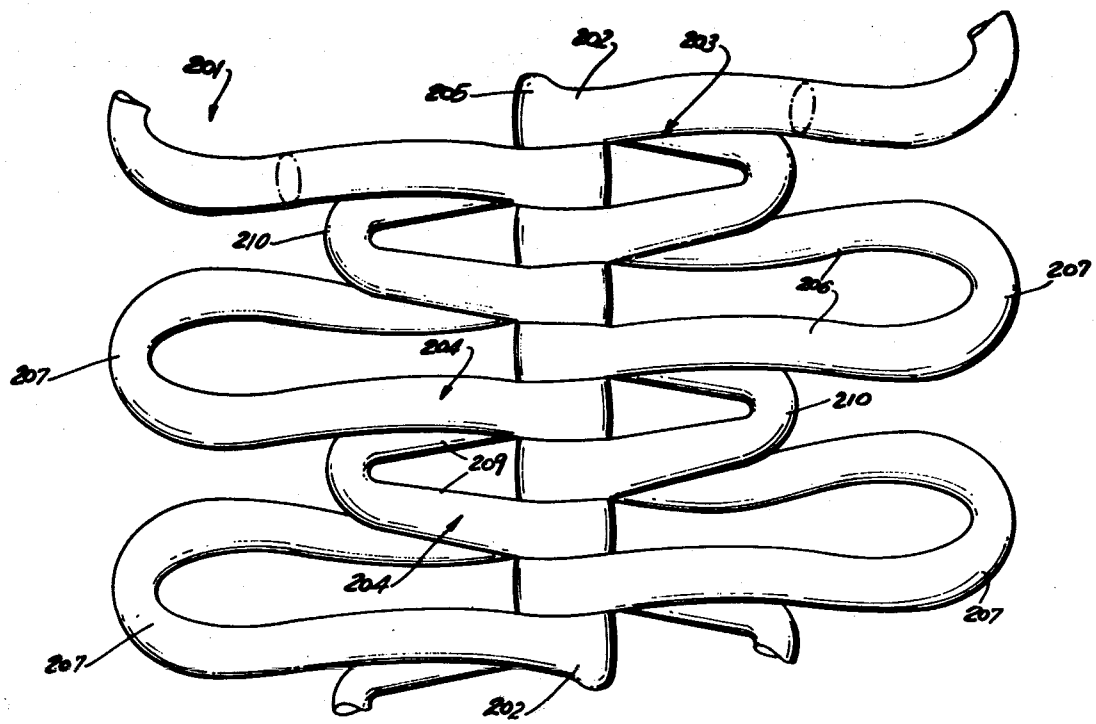
FIG. 22 is a plan view of still another fastener arrangement.

In FIG. 22, long and short shanks 206, 209 of oval cross section are free from any projecting bosses and form loop ends 204 of equal size.

The slide fastener shown in FIGS. 19–22 uses the basic helical turns of the coupling rows described but form a tape-like structure 220 with the textile threads 208. Here also, the shanks 206 lie in the slide fastener plane and are interconnected by distal bights 207. The coupling eyes 203 project beyond the longitudinal threads and the shanks 206 lie in separate longitudinal thread pockets 211 also as previously described. In this embodiment, unlike the embodiments previously described, the long shanks 206 are not straight and have generally an S configuration over their entire lengths. The arcuate region 219 of both sets of shanks for each coupling element may be pressed together where the two lie in a corresponding pocket of the warp threads.

Figure 23:
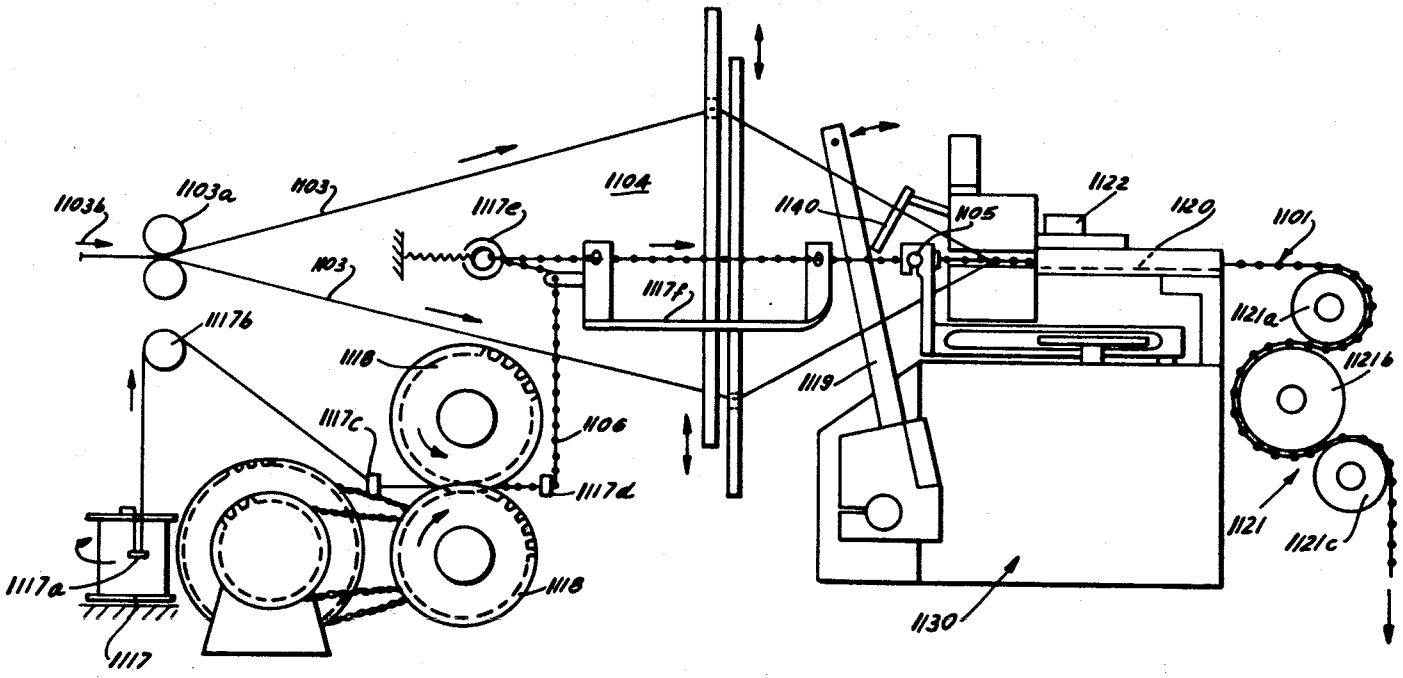
FIG. 23 is a diagrammatic side view of a slide fastener-making apparatus according to my present invention.
Figure 24:
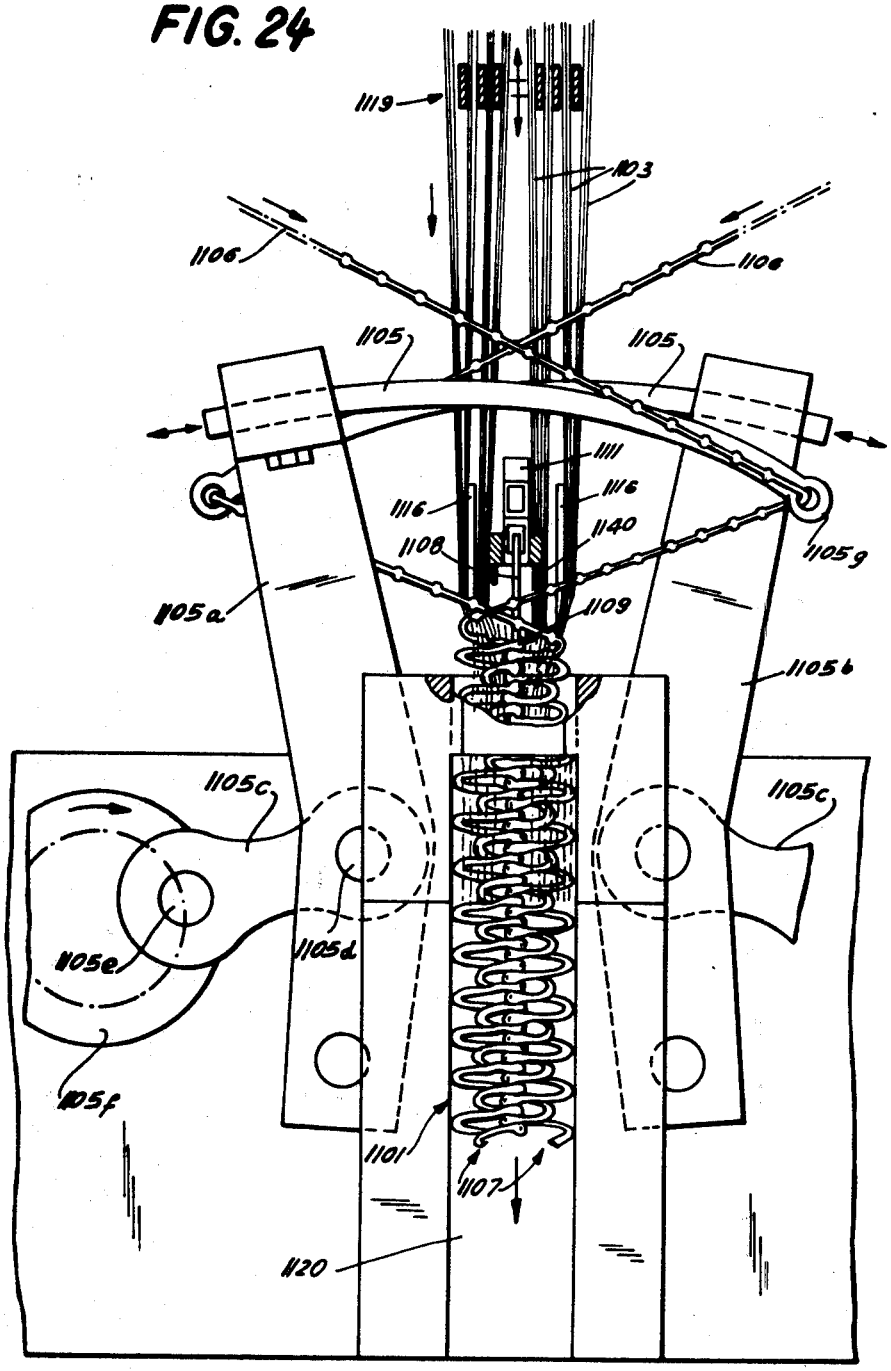
FIG. 24 is a plan view of a section of FIG. 23.
Figure 25:
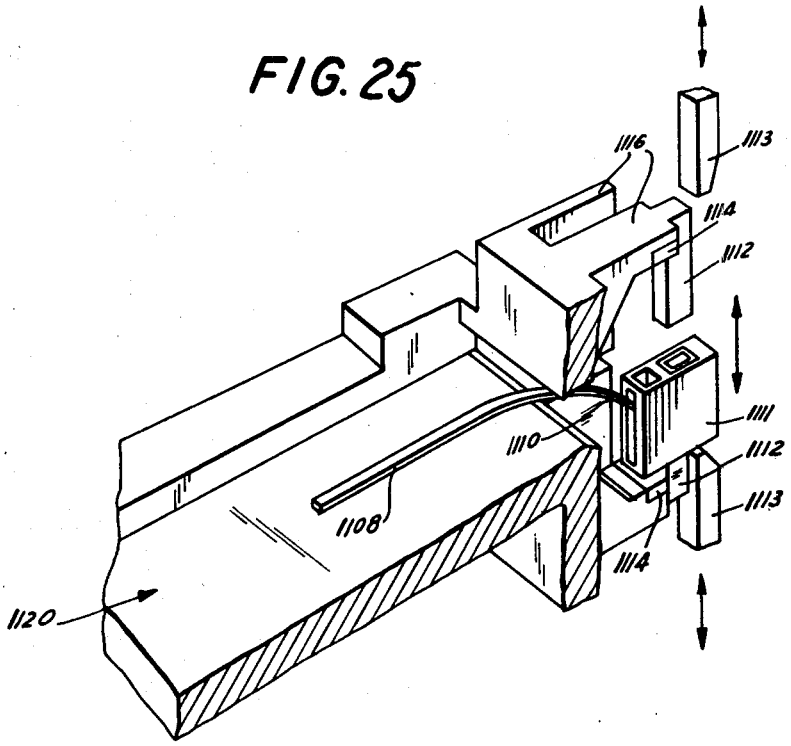
FIG. 25 is an isometric view of the apparatus of FIG. 24 partly cut away.
Figure 26:
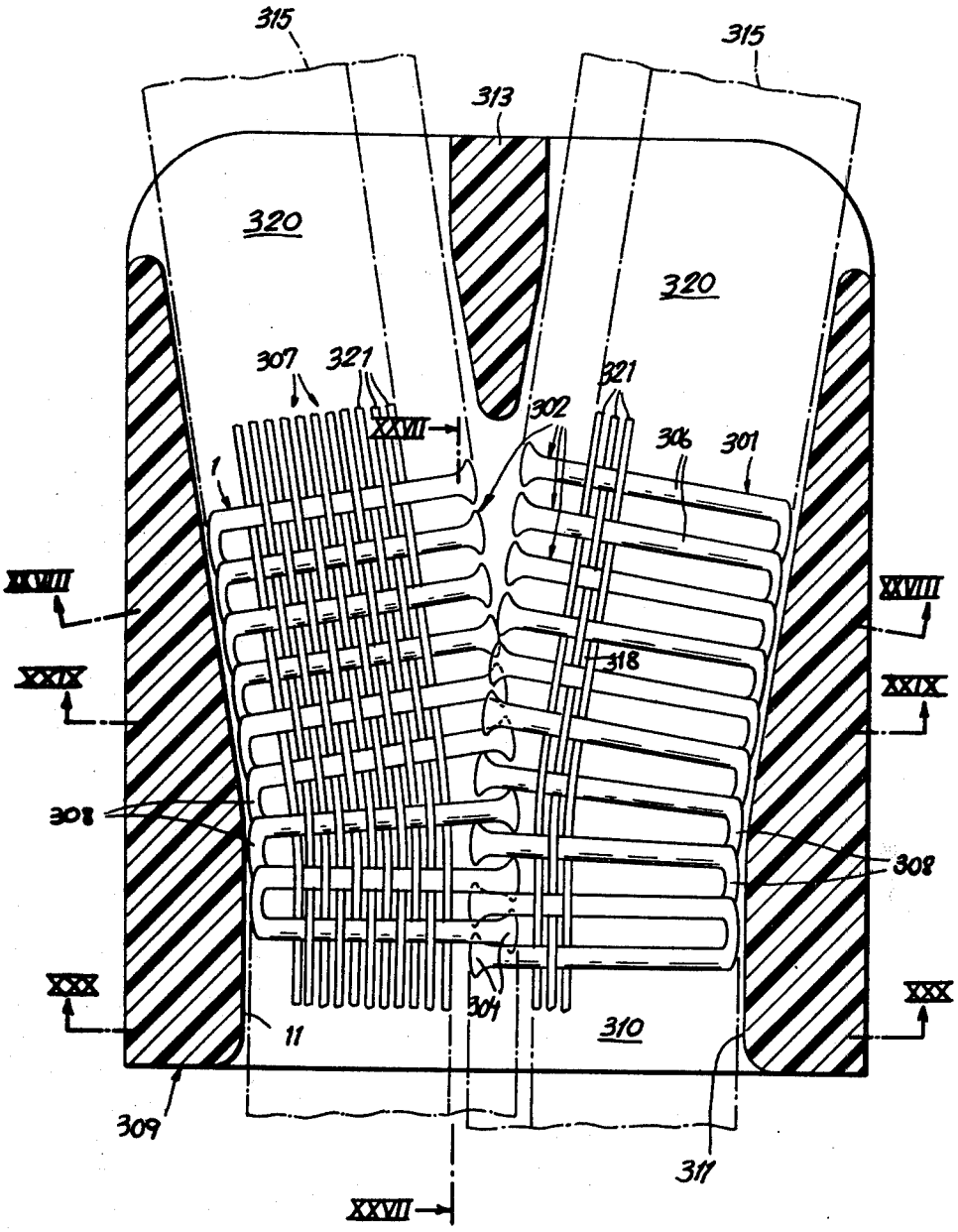
FIG. 26 is a diagrammatic section, taken parallel to the plane of a slide fastener, through a slider on a slide fastener, the system being greatly enlarged over the actual size.

FIGS. 23 and 24 illustrate the basic elements of the apparatus for fabricating the interdigitating (tapeless) slide fastener structures shown at the lefthand side of FIGS. 14 and 17 and represented, in FIGS. 23 and 24, at 1101.

This unit differs from that of FIGS. 8–13 as to member 1140.

The apparatus comprises a warp-feed beam (not shown) from which the warp threads 1103 are passed between a pair of rollers **1103*a* in the direction of arrow 1103*b*, the warp threads traversing respective heddles 1102*a* of a harness 1102 capable of forming a warp shed 1104. As will be apparent from FIG. 24**, the warp threads are divided into two groups and have a space between them.

From each side of the loom, respective weft-inlaying needles 1105 carry the respective synthetic-resin monofilaments 1106 into and through the respective sheds. To this end, the needles 1105 are carried by arms **1105*a* and 1105*b* driven by links 1105*c* which are articulated to the arms 1105*a*, 1105*b* at pivots 1105*d*. Each link is swingable on an eccentric pin 1105*e* driven by a wheel 1105*f* so that the needles are swung alternately to the right and to the left through respective sheds. The needles are synchronized with the heddle control (not shown) which can be of the usual type-weaving type, and with the batten ro reed 1119 which is swingable, as can be seen in FIG. 23, to beat up the weft as it is led into the shed. Guides 1116 engage the filaments to form the bights remote from the heads and prevent the weft inlaying from pulling the warp 1103** inwardly.

As is also apparent from FIG. 23, at each side the monofilament 1106 is drawn from a spool 1117 through a traveling eye **1117*a* and passes over a guide roller 1117*b* and between a pair of eyes 1117*c* and 1117*d* between a pair of embossing rollers 1118 which can be heated ultrasonically or otherwise to form the bosses 1106*a* (corresponding to the bosses 218 of FIGS. 14–6) therein. The embossed monofilament is then passed through a spring loaded eye 1117*e* and a guide 1117*f* to the eyelets 1105*g* of the respective weft-inlay needle. The loom housing 1130 is formed with a channel 1120 through which the interlocked coupling elements are guided on to a takeoff unit 1121 comprising a plurality of rollers 1121*a*, 1121*b* and 1121*c* which frictionally engage the strip and reversely bend it to facilitate variation of the strip. A thermofixing device in the form of a heater as represented at 1122 above the guide 1120 can be provided and, as will become apparent hereinafter, the bending mandrel 1108** can also be extended into a heated portion which effects thermofixing of the heads to serve as a connecting wire until thermofixing is complete.

The flexible mandrel 1108 is disposed centrally between the weft sheds 1104 for the respective slide fastener halves and, at the end 1110 of the mandrel turned away from the downstream end 1109 of the weft shed, is mounted in a raisable and lowerable mandrel holder 1111 slidably.

As can be seen from FIG. 24, the weft-inlaying needles 1103 lie in horizontal planes disposed one above the other so that their filament-entraining ends can cross over in the shed 1104.

The mandrel holder 1111 is received in a centrally interrupted vertical guide 1112 and can be shifted by a plunger arrangement 1113 between its upper and lower positions in which it is retained by magnets 1114.

Of course, this holding arrangement 1114 can be eliminated and the device can be constituted as previously described, with rounded corners so that it is cammed (FIGS. 11, 11*a* and 11*b*) into its upper and lower positions.

The device illustrated in FIGS. 23 through 24 operates as follows:

Two supply spools 1117 feed respective synthetic-resin monofilaments 1106 through respective embossing roller pairs 1118 to the respective weft needles. As can be seen from FIG. 24, the weft needles 1105 lay the monofilament 1106 into the warp shed across the lower set of warp threads and pass the mandrel 1111. The mandrel 1111 thereupon drops and the needles 1105 withdraw the filament again only limitedly across the lower threads of the shed until respective fingers 1140 swing in to intercept the filament and form the proximal bights 110. The harness is actuated to reverse the shed and the weft is beaten up by the reed 1119. Each shed, therefore, forms a pocket for a pair of mutually contacting shanks of the coupling elements. The process is repeated with the new shed and as many times as necessary to produce the desired length of slide fastener.

The length of the mandrel 1108 is so selected that the coupling heads withdraw therefrom only after a considerable number of coupling heads are interdigitated by the needles. The mandrel can remain in place within the coupling heads until thermofixing has relaxed the stresses of the monofilament. Advantageously, the warp filaments are shrinkable and are subjected to a thermal shrinking operation to reduce their length by 10 to 15% to ensure a particularly tight grip of the shanks in the warp pockets.

The system has been described for the fabrication of a substantially coiled coupling element, in which the coupling heads are generally wound around the mandrel. However, it is possible to provide the coupling elements 1107 as U-shaped meander structures in which case the inlaying needles 1105 are displaced following the respective weft inlays so that one monofilament is brought over the other and vice versa in successive operations.

FIGS. 26–30 and 32 show a slide fastener which comprises a pair of rows 301 of coupling elements formed from syntheticresin monofilament (generally polyester or nylon), each of these rows comprising coupling elements 302 whose coupling heads 304 are provided with lateral protuberances on coupling eyes or loops 303. The coupling eyes or loops 303 are formed by opposite monofilament segments 305 of arcuate configuration and connecting shanks 306 which extend from these segments 305 away from the coupling heads.

The shanks 206, as described more fully in the above-identified copending applications and as shown in the present drawing, lie next to one another for each coupling element and abut one another within respective pockets of the support structure formed by these shanks and a multiplicity of longitudinal threads 221.

The support structure is represented diagrammatically at 307 and as the coupling eyes 303 projecting laterally therefrom along a confronting edge of the support structure. This confronting edge of the support structure is locked to the confronting edge of the opposing support structure by the movement of a slider therealong as described hereinafter.

The shanks of adjoining coupling elements are interconnected by bights 308 which lie along the lateral edges of the support structures 307 and form guides or rails along which the slider 309 is displaced.

The slider 309 comprises a unitary upper shield 310 formed with a pair of laterally overhanging flanges 312 which underlie the support structures 307 and define with the upper shield 310 channels in which the support structures are guided or received.

Figure 29:
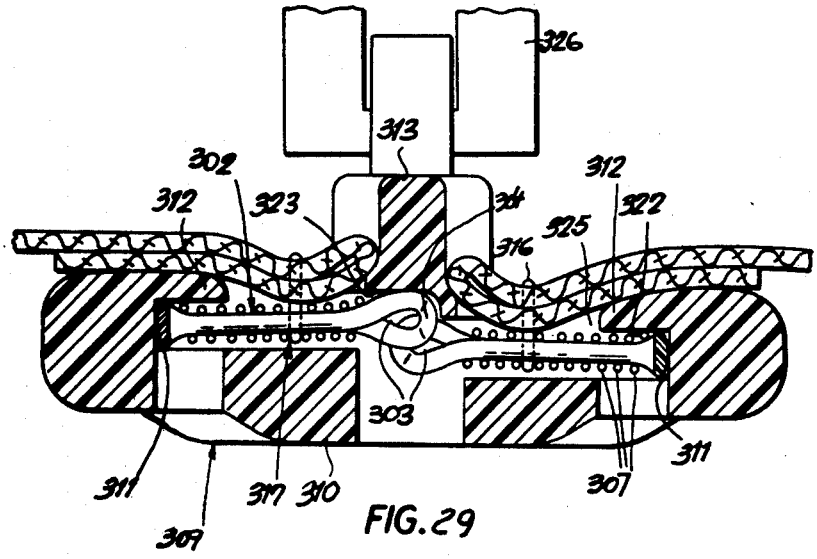
FIG. 29 is a section taken along the line XXIX—XXIX of FIG. 26.

The channels are formed with the lateral guide surfaces 311 which, as can be seen from FIG. 29, for example, slide along the outer surfaces of the bight 308.

Close to the mouth of the slider there is provided a heart piece or divider 313 which lies centrally of the slider and extends from the shield 310 to the opposite side thereof.

Figure 30:
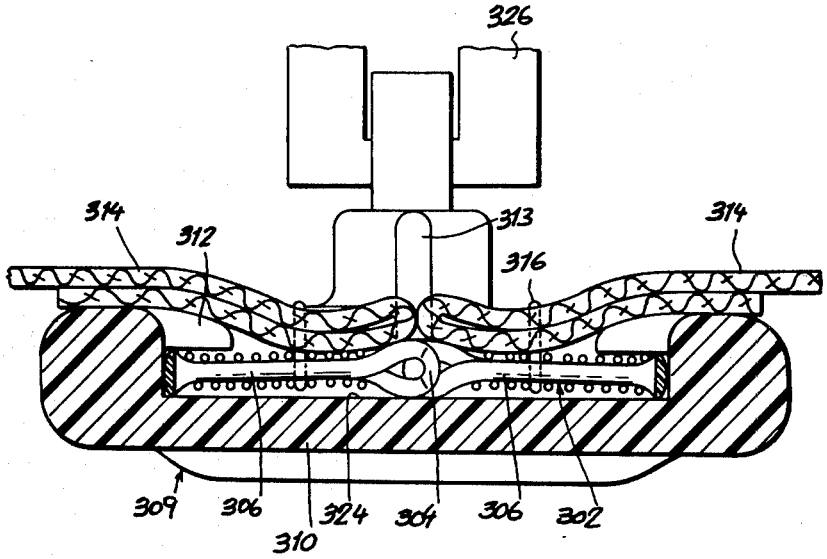
FIG. 30 is a section taken along the line XXX—XXX of FIG. 26.
Figure 31:
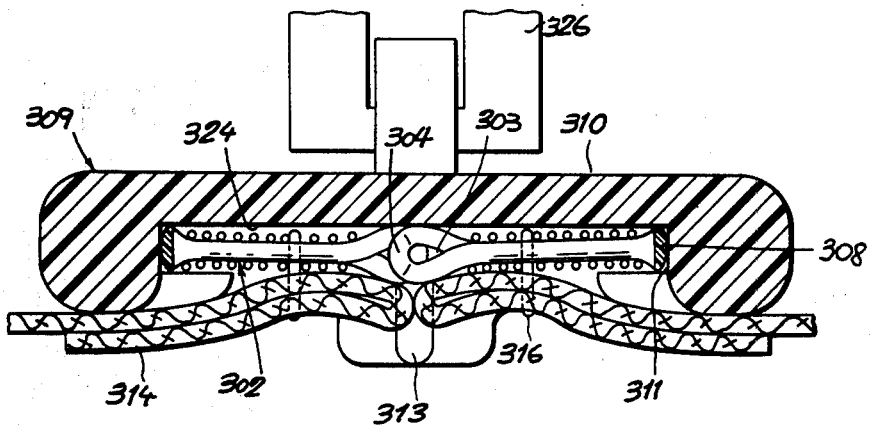
FIG. 31 is a section corresponding to FIG. 30 of another embodiment of a slide fastener and slider arrangement according to the invention.
Figure 32:
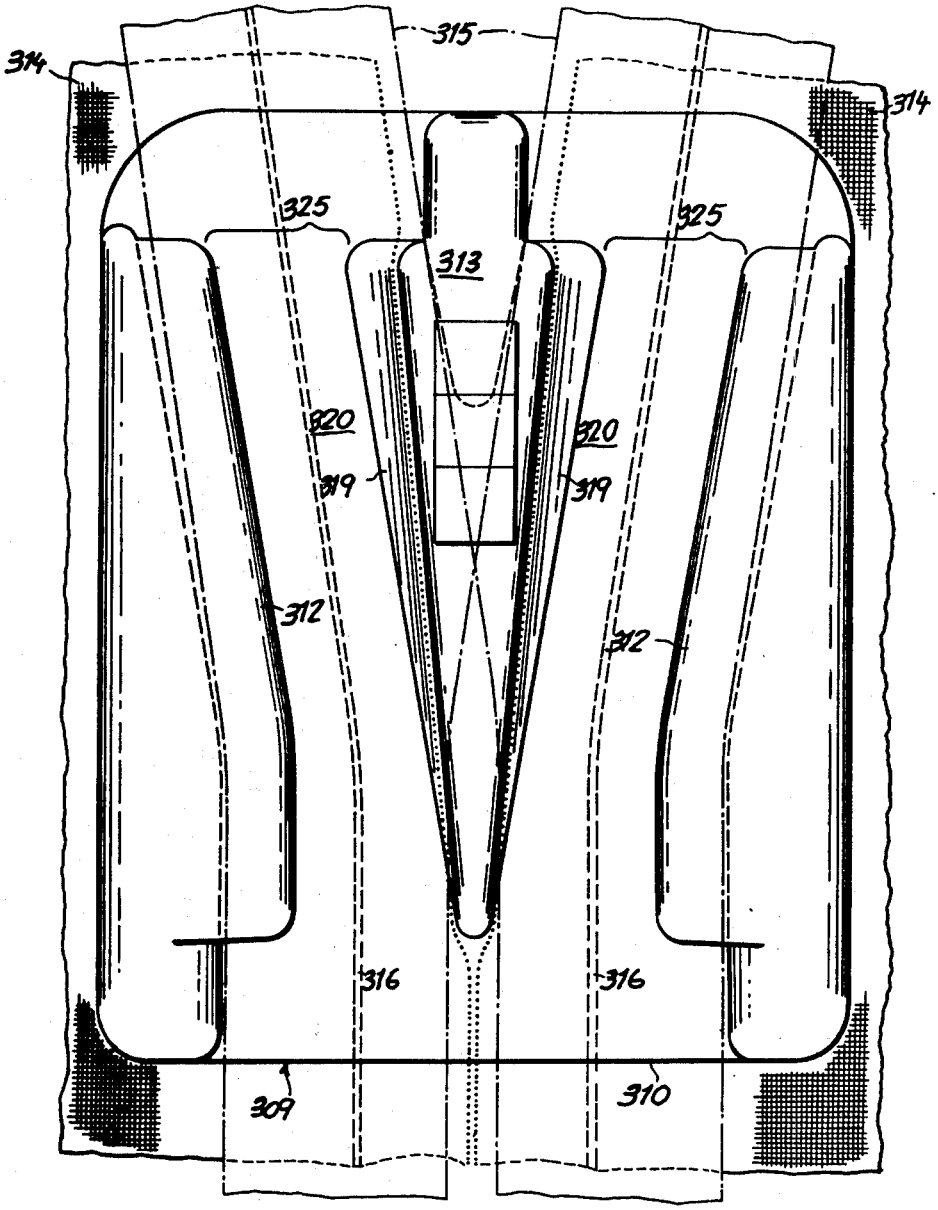
FIG. 32 is a plan view of the slider and slide-fastener arrangement, parts of the latter being shown diagrammatically, of the system of FIG. 26.
Figure 33:
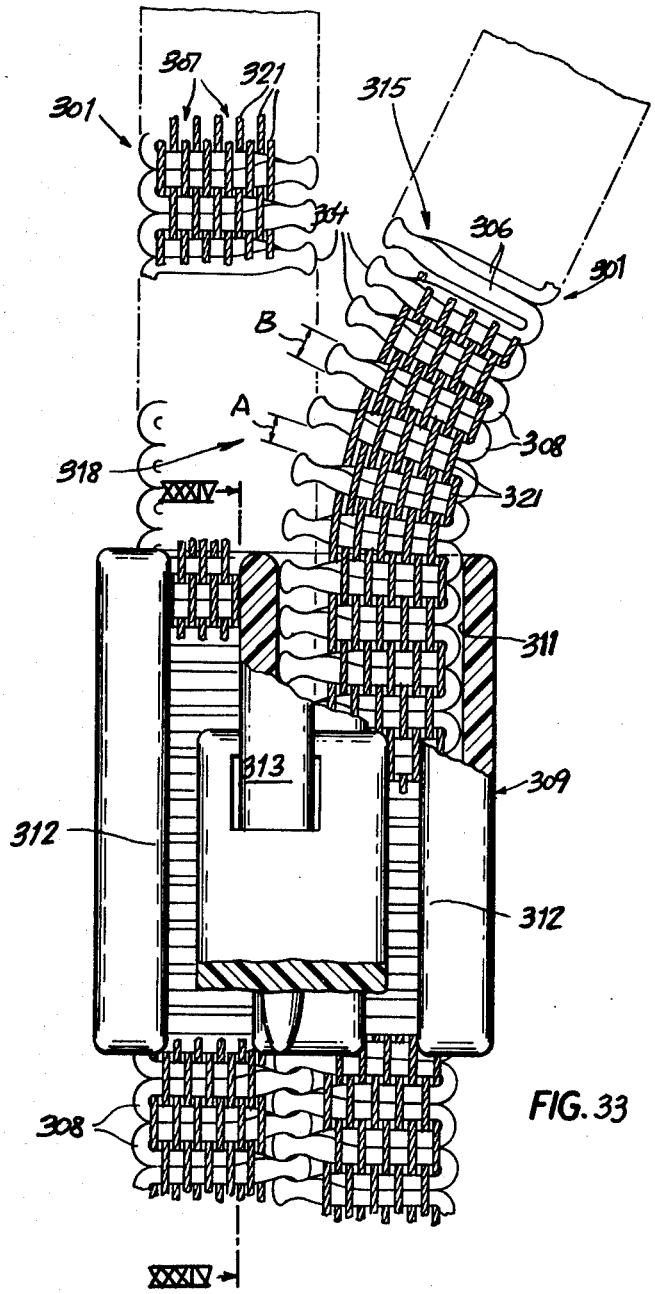
FIG. 33 is a plan view of another embodiment of a slide fastener and a slider, partly broken away and partly in diagrammatic form.
Figure 34:
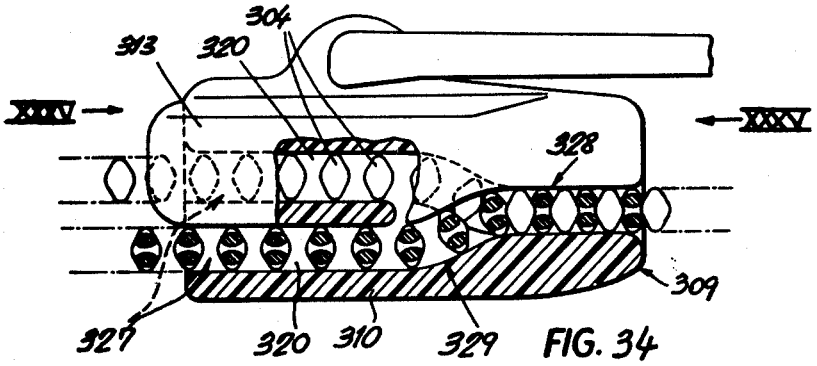
FIG. 34 is a section taken along the line XXXIV—XXXIV of FIG. 33.
Figure 35:
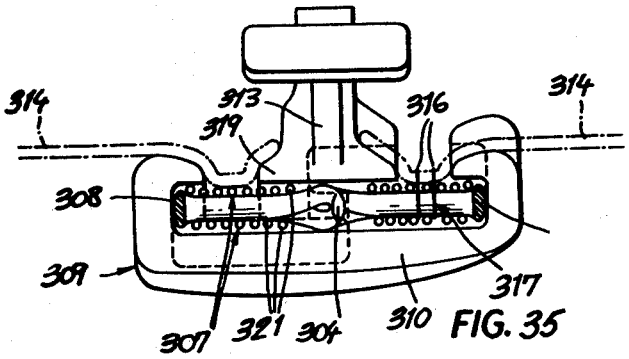
FIG. 35 is a view of the slider of FIGS. 33 and 34 taken in the direction of arrow XXXV in FIG. 34.
Figure 36:
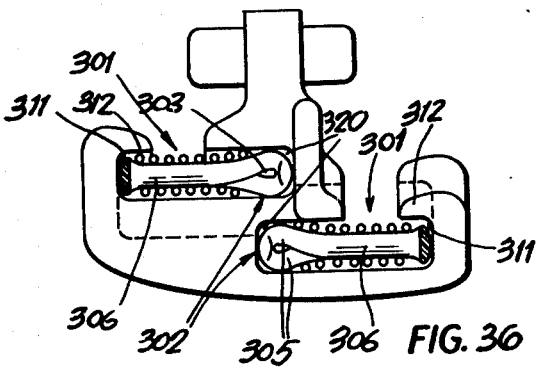
FIG. 36 is a view of the arrangement shown in FIGS. 33–35 but taken in the direction of arrow XXXVI of FIG. 34.
Figure 37:
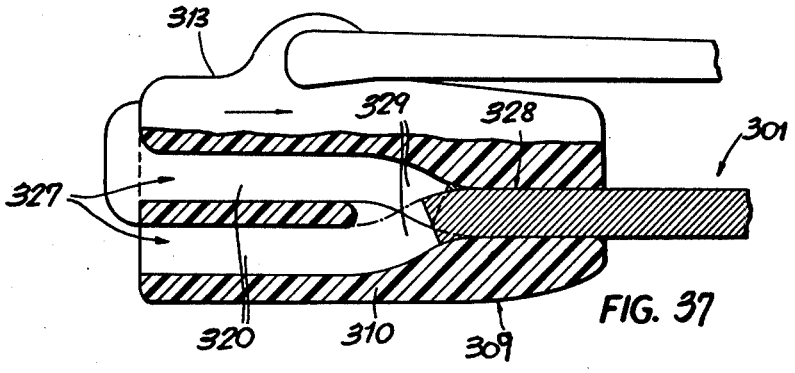
FIGS. 37–39 are diagrammatic longitudinal sections illustrating the insertion of the slider on the slide fastener and the movement thereof from the beginning of the stringer toward the end thereof.
Figure 38:
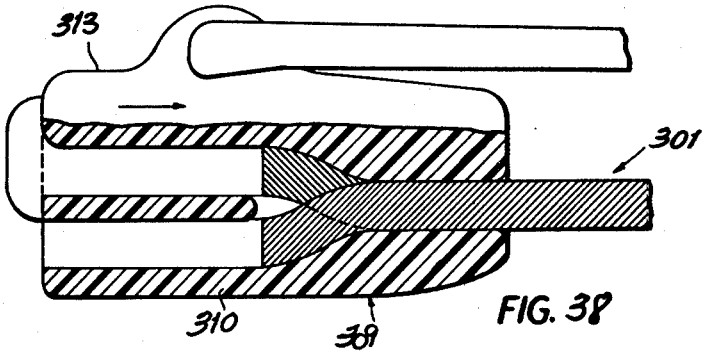

Of course, as a comparison of FIGS. 26–30 with FIG. 31 will show, the upper shield 310 of the slider can be provided at the same side as the handle 326 or at the slide opposite the handle 326, provided that it directly overlies the coupling strips 307 which are to be joined together or separated by this slider. In FIG. 30, for example, the shield 310 overlies the coupling strips 307 from the underside of the fabric 314 while in FIG. 31, the coupling strip can be applied to the exposed surface of the fabric and the slider is displaceable along this side.

The strips 315 are secured to the garment 314 by rows 316 of stitching, the stitches of the rows engaging around the shanks 206 as can be seen at 317 in FIGS. 26–31.

In this system, the spreadability of the coupling elements 302 is limited by the support structure 307. This spreadability is represented at 318 in FIG. 26.

The spreadability is limited to a free space A between the eye-forming monofilament segments 305 which is sightly less than the width B of the coupling heads as measured in the longitudinal direction of the slide fastener.

These measurements are given as seen in projection upon the slide fastener plane in the spread state of the coupling elements 302, i.e. with a V-shaped orientation of the coupling strips 315.

The slider 309 has its divider formed with fabric deflecting flanges 319 which will be discussed in greater detail below, these flanges serving to deflect the edges 314*a* of the garment away from the eyes 303 and rearwardly as the slider is shifted along the slide fastener.

The divider 313 subdivides the interior of the slider 320 (in the region of the divider) into two guide channels 320 for the respective strips 315, these channels being oriented for press interfitting of the two rows of coupling elements. Press interfitting is of course used herein to describe the process whereby the coupling elements of one row are pressed between the coupling elements of the other row in a direction transverse to the plane of the slide fastener.

In FIGS. 26–31 and, in accordance with the preferred embodiment of the invention, the tape-like unit or support structure 307 is formed with longitudinal threads 321 of textile fibers which can be warp threads of a weave in which the shanks 306 form the weft and are received in pockets of the warp. Alternatively, the longitudinal threads 321 can represent loop chains of a warp knit whose courses receive the respective shank 306. This configuration strictly limits the spreadability of the coupling elements.

As noted, it is a preferred embodiment of the invention to constitute the shanks 306 as weft threads interwoven with the longitudinal or warp threads 321.

Since the synthetic-resin monofilament can have a relatively small diameter, e.g. about 0.5 mm, the elastic deformability of the coupling elements 302 can be use to facilitate the press-fitting of the heads. In this case the free space A can be slightly less than the width B of the coupling head 304. When the coupling elements are more rigid, however, and the elastic deformability of the coupling element cannot be considered, the free space A should be equal to the width B of a coupling head.

Figure 28:
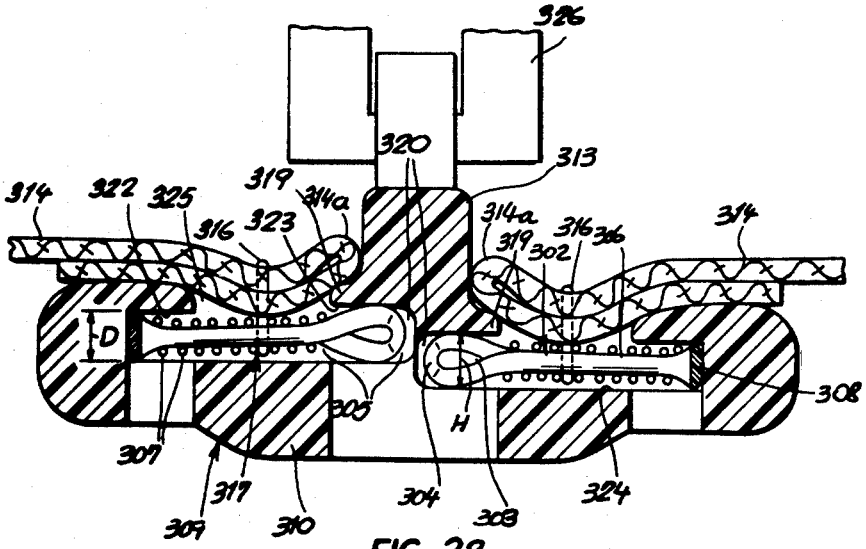
FIG. 28 is a section taken along line XXVIII—XXVIII of FIG. 26.

As FIGS. 28–30 make clear, the guide channels 320 conform in thickness or height D and H, respectively, to the thickness of the slide-fastener strips 315 in the region of the shanks 306 and the thickness in the region of the coupling eyes 303 and the coupling heads 304. These dimensions on the slider are defined between the inner surface 322 of the overhanging flanges 312 and the undersides 323 of the fabric-deflecting flanges 319, respectively, and the inner surface 324 of the shield 310.

Between the inner edges of the overhanging flanges 312 and the fabric-deflecting flanges 319, there are provided throughgoing slots 325 which clear the stitch seams 316. These slots are especially apparent in FIG. 32.

The handle 326 for actuating the slider can be anchored directly to the divider 313 and hence can be provided on the side thereof remote from the shield 310 or can be provided directly upon the shield as a comparison of FIGS. 30 and 31 will reveal. This only depends upon whether the slider is to be of the so-called invisible typetype (FIGS. 26–30 and 32) in which the edges 314*a* of the fabric come together to conceal the slide fastener, or of the freely visible type (FIG. 31) wherein the coupling strips 315 are visible from the side at which actuation takes place.

FIGS. 33–39 describe a particularly advantageous embodiment of the invention which, however, is basically similar to that of FIGS. 26–32 and hence similar reference numerals have been used to designate similar structure.

Thus the rows 301 of coupling elements 302 are composed of synthetic-resin monofilaments, the coupling elements having coupling eyes 303, coupling heads 304 whose formations project from the coupling eyes, eye-forming monofilament segments 303 and shanks 306 which extend the full width of the coupling strips 315. The shanks 306 of each coupling element are not superposed relationship (see FIGS. 26–32) but rather lie side-by-side in mutually abutting relationship in a plane corresponding to the slide fastener plane. As in the case of the superimposed shank arrangement of FIGS. 26–32, the shank of FIGS. 33–36 form a double weft interwoven with the warp filaments 321. The eyes 303, however, lie in planes perpendicular to the slidefastener plane so that the loop or eye-forming segments 305 are superposed in the region of the heads so that they have common projections, for each coupling element, in the plane of the slide fastener. The bights extend out of each warp pocket containing two shanks and into the next warp pocket. Instead of the shield arrangement shown in FIG. 35 which is equivalent to that of FIG. 30, the shield can be provided as shown in FIG. 31, i.e. reversed with respect to the handle or grip.

Figure 27:
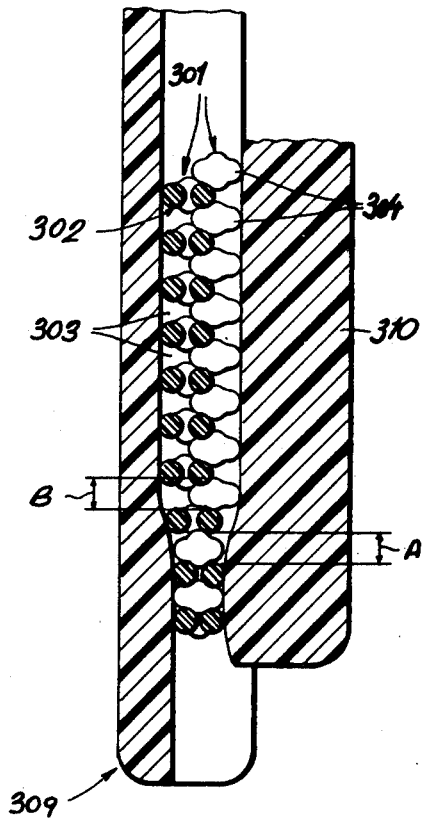
FIG. 27 is a section taken along the line XXVII—XXVII of FIG. 26.
Figure 39:
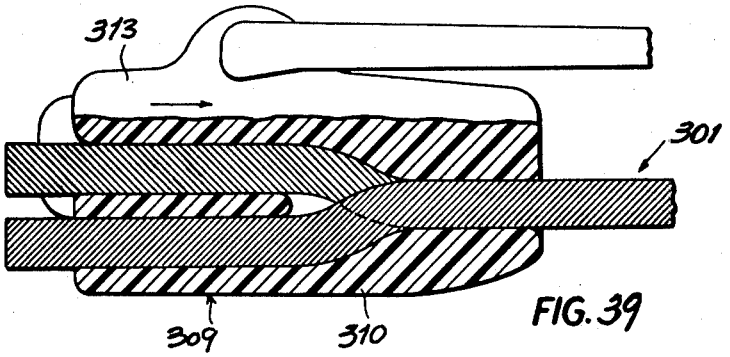

In this embodiment as in the embodiment of FIGS. 26–30, the leg sections 327 of the channels are parallel and merge into a trunk section 328 at inclined transition sections 329 so that the channels have a tuning fork configuration as seen in projections on a plane corresponding to the plane of the paper in FIGS. 27 and 309 and hence in a plane perpendicular to the slide-fastener plane but parallel to the axis of the slide fastener. This, of course, permits the slider (FIG. 37) to be fed into the slide fastener through the trunk channel 328 and gradually moved along until separation of the coupling elements begin (FIG. 38), the normal opening movement being then effected as shown in FIG. 39.

The rows of coupling elements shown fragmentarily in FIGS. 40–58 of the drawing comprise basically coils 402 of the interdigitated pair of coils 401 of a slide fastener. The coils form coupling elements 403 of synthetic-resin monofilament which have coupling eyes 404 each defining coupling heads 406. The coupling heads 406 are enlarged longitudinally of the slide fastener so as to interfit between the coupling heads of the opposite row, the eyes 404 being formed by synthetic-resin monofilaments segments 405 which extend rearwardly into shanks 407.

Shanks 407 of the individual coupling elements 404 lie next to one another and can abut directly so that each pair of shanks of a given coupling element lie in a common pocket of the warp.

The shanks 407 of adjoining coupling elements are spaced apart by a distance A and are interconnected by bights 408.

Figure 40:
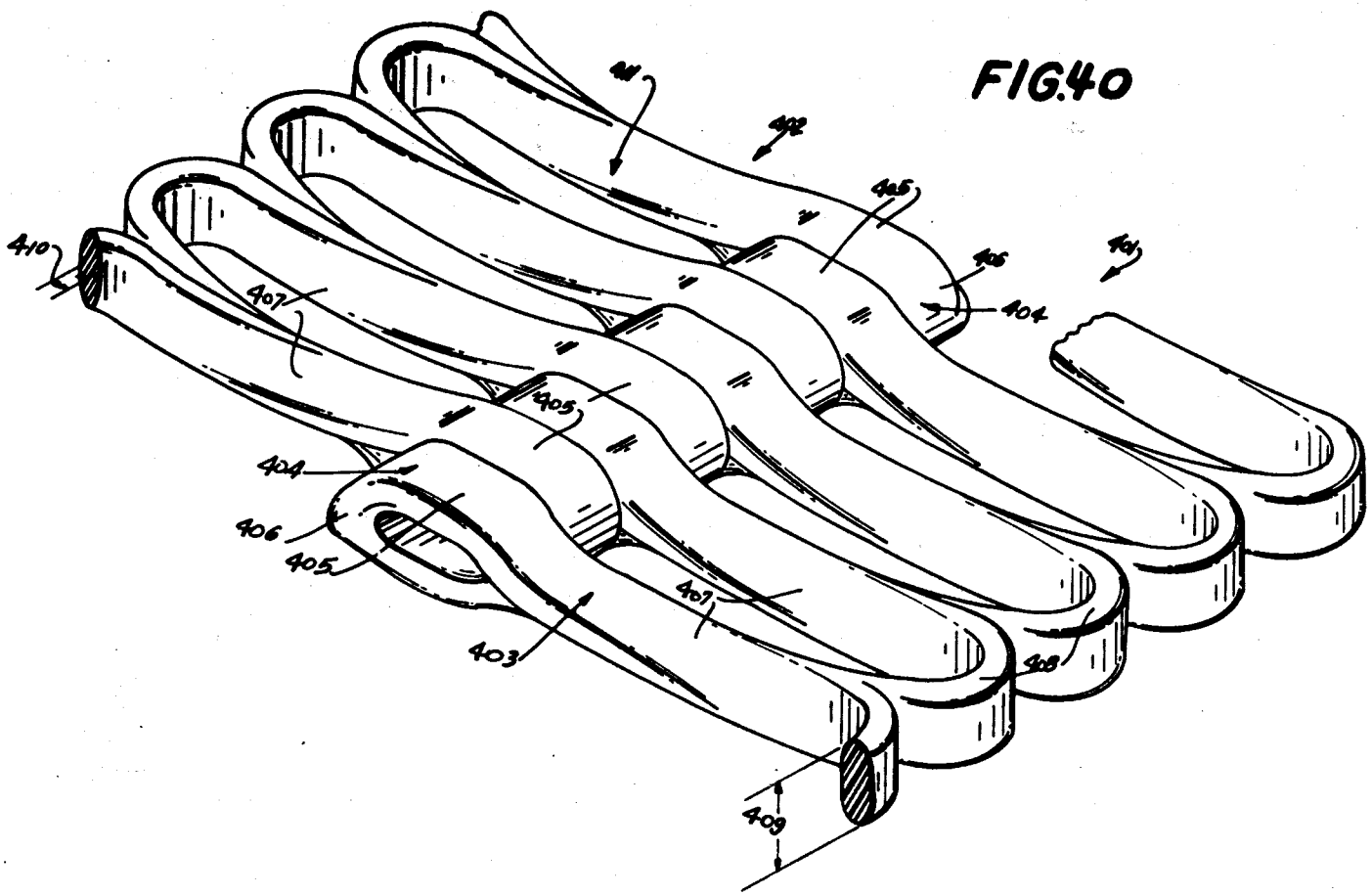
FIG. 40 is a perspective view of another coupling system which can be made with the process of the invention.

As a comparison of FIGS. 40 through 51 will demonstrate, the shanks 407 directly abut and either can lie generally parallel to the slide fastener plane or can be inclined more or less orthogonally or at acute angles thereto. Preferably the shanks lie next to one another as shown in FIG. 40 so that they lie more or less in a common plane although vertically superimposed relationships of the shanks of each coupling element are also possible. FIGS. 48 through 51 show an arrangement in which the shanks are more or less inclined to the slide fastener plane and, for the most part, lie one above the other.

Figures 46, 47:
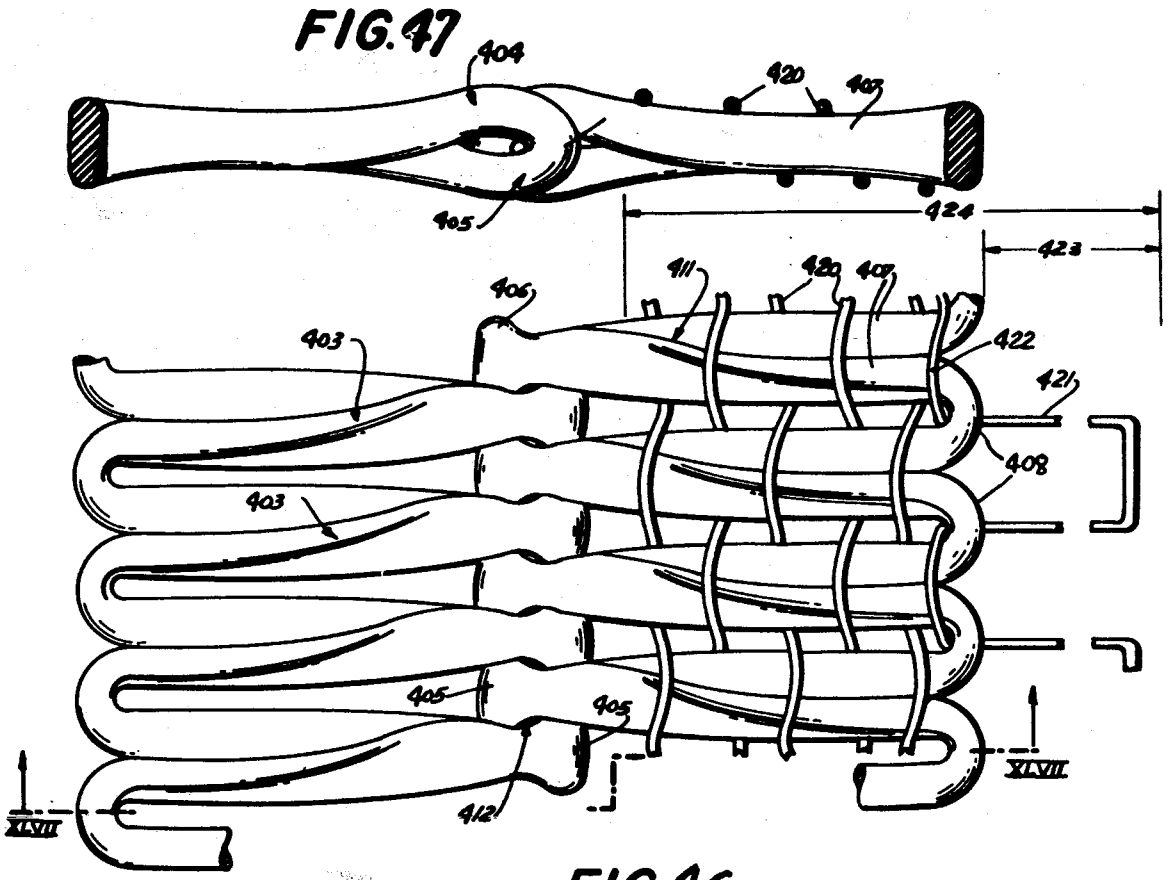
FIG. 46 is a view similar to FIG. 40 illustrating another embodiment.
FIG. 47 is a cross-sectional view taken along the line XLVII—XLVII of FIG. 46.
Figure 49:
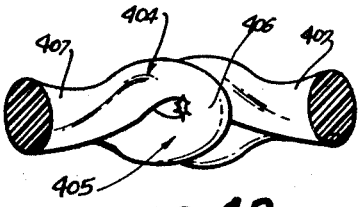
FIG. 49 is a cross-section taken along the line IL—IL of FIG. 48.
Figure 48:
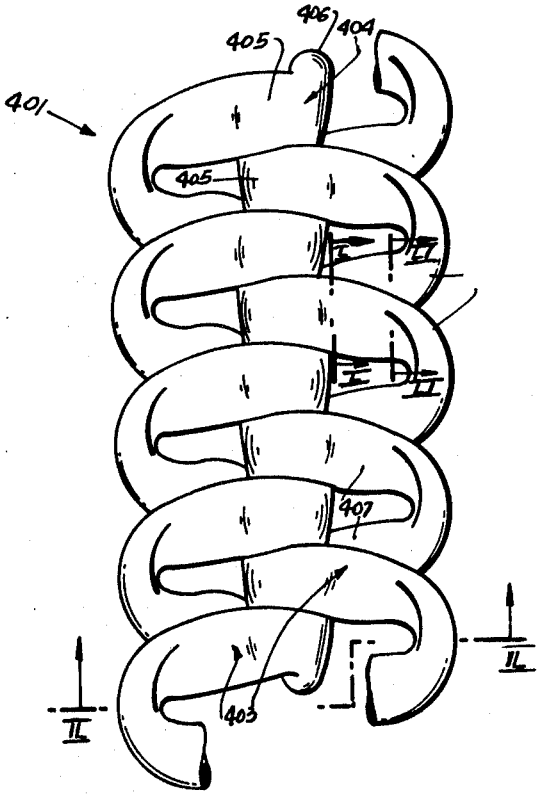
FIG. 48 is a view similar to FIG. 46 showing still another embodiment having relatively short shanks interconnecting the coupling heads and the bights.
Figure 50:
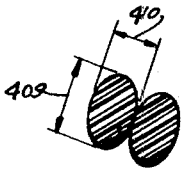
FIG. 50 is a cross-sectional view taken along the line L—L of FIG. 48.
Figure 51:
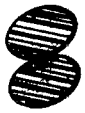
FIG. 51 is a view taken in section along the line LI—LI of FIG. 48.

In general the shanks 407 are formed into coupling strips with the aid of textile longitudinal threads which have been represented at 420 in FIGS. 46 and 47. When the bights 408 form the edge of the strip, no additional weft threads are required and each pair of shanks of a given coupling element lie as a double weft in the structure formed by the warp threads. However, it is also possible to provide an additional tape 423 so that the overall coupling element and tape arrangement is represented at 424. A weft thread 421 of the tape portion 423 is looped around the bights 408 as shown at 422.

As is best seen from the cross-sectional views of FIGS. 42–45, 47 and 49 through 51, the synthetic-resin monofilaments of the coupling elements 402 is substantially ellipsoidal in section and have a relatively long axis 409 and a relatively short axis 410, the axes 409 and 410 corresponding to the major and minor axes of the ellipse.

In the region of the coupling heads 409 and the eyes 405, the long axis 409 of the cross section is parallel to the slide fastener plane and, therefore, to the axis of the respective coils. In the region of the bights 408, however, the long axis 409 lies perpendicular to the slide fastener plane. In the case of the bights 408, therefore, the short axes 410 lie parallel to the slide fastener plane at any cross section through the bight.

In the region between the coupling eyes 405 and the bights 408, the shank 407 is formed with transition twists 411 such that the total twist rotates the ellipse through approximately 90°. In the embodiment of FIG. 40 the twist is substantially uniform from the coupling eyes to the bight over the lengths of the shanks 407.

Figures 41, 42, 43, 44, 45:
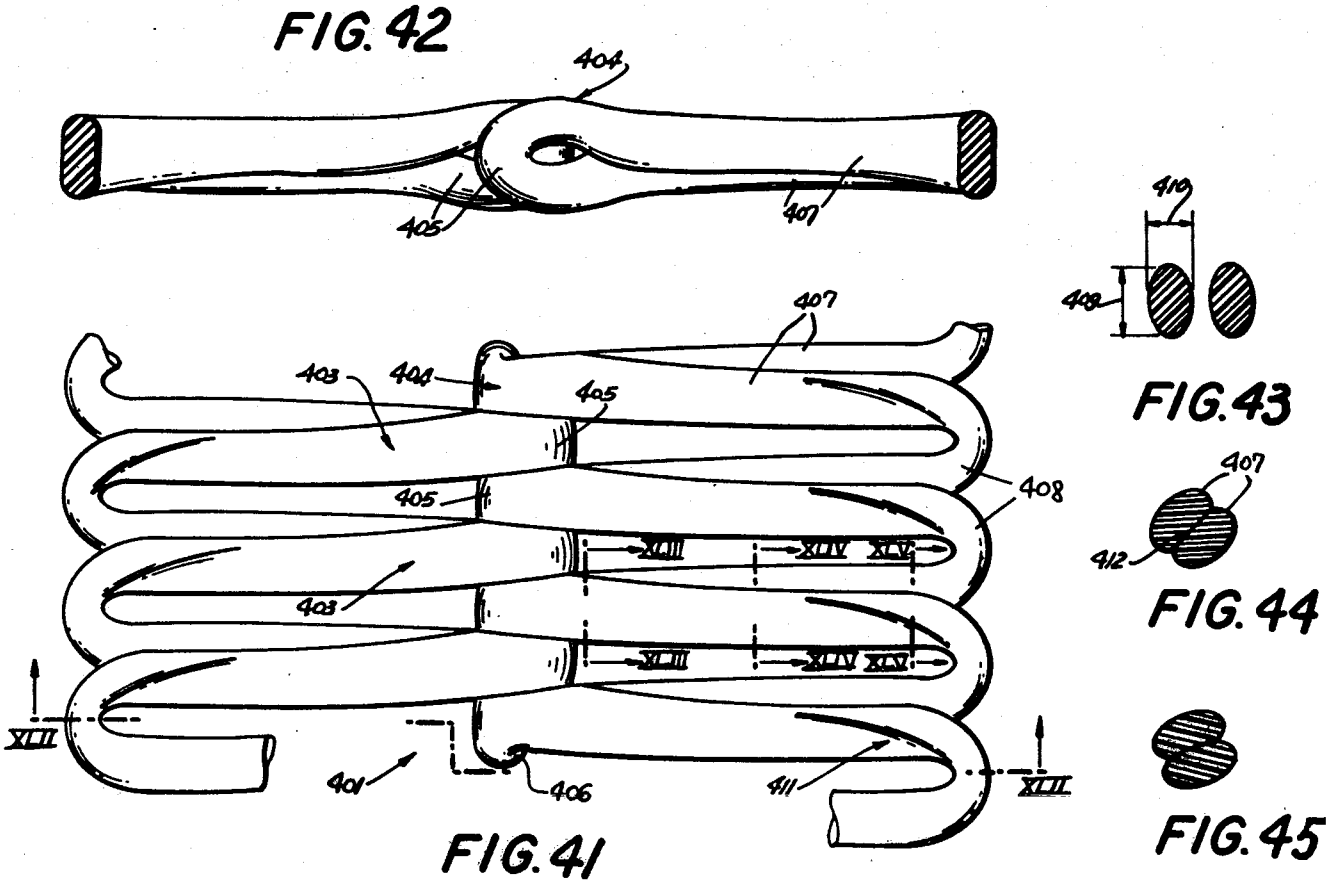
FIG. 41 is a plan view of a pair of coupling rows according to an embodiment corresponding to that of FIG. 40.
FIG. 42 is a cross-sectional view taken along the line XLII—XXLII of FIG. 41.
FIG. 43 is a cross-sectional view taken along line XLIII—XLIII of FIG. 41.
FIG. 44 is a cross-sectional view taken generally along the line XLIV—XLVI of FIG. 41.
FIG. 45 is a cross-sectional view taken along the line XLV—XLV of FIG. 41.

In FIG. 41, however, it can be seen that the major portion of the twist is displaced towards the bights 408

To ensure effective abutting relationship between the paired shanks, they may be pressed together as best seen, for example, in FIGS. 44 and 45 to lie in surface contact along mutually confronting and contacting flats which can be formed in the coupling elements when they are pressed together along the shanks.

The ratio of the axial lengths of the long axis 409 to the short axis 410 in regions other than those in which the additional flat means 412 are provided, are between 1:1.5 and 1:2.

As noted previously, the shanks 407 can be as long as required to incorporate the shanks as the weft in a weave having longitudinal threads forming the warp and crossing over between each pair of shanks.

It is possible to provide the shanks 407 as relatively short (FIGS. 48 through 51), the latter arrangement being desirable when the coupling elements are to be stitched to a tape or to be incorporated in a knit or weave as a support tape by conventional means.

Figure 52:
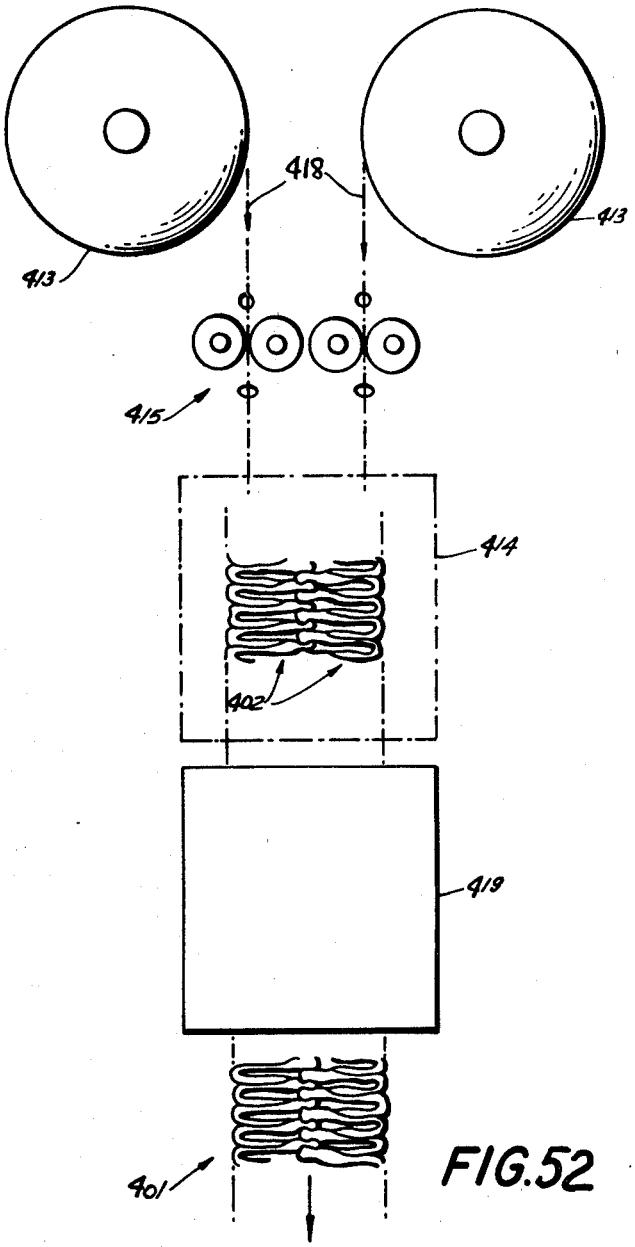
FIG. 52 is a schematic diagram illustrating the flattening of the cylindrical synthetic-resin monofilaments forming the coupling elements of FIGS. 40–51.
Figures 53, 54, 55, 56, 58:
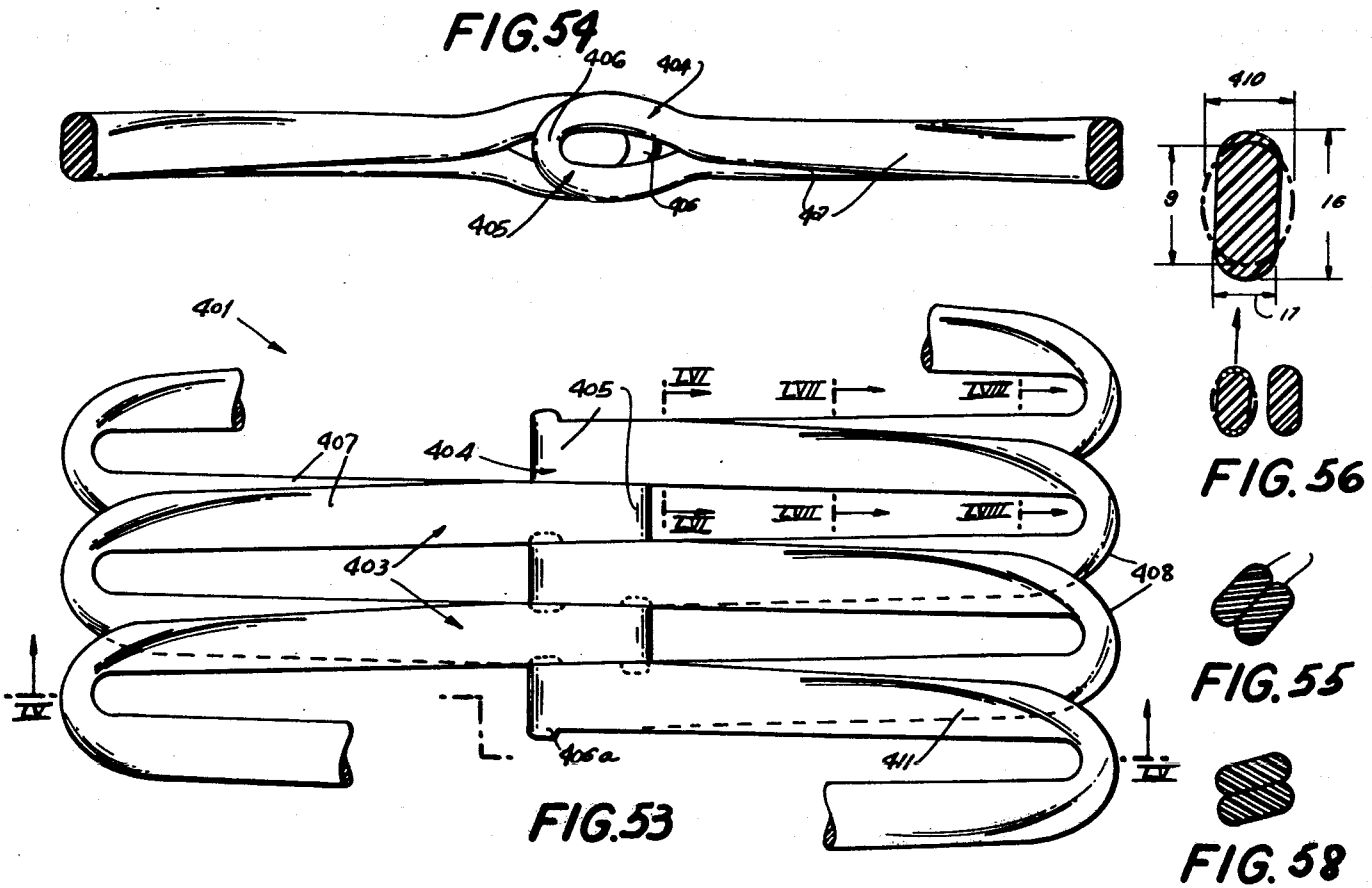
FIG. 53 is a view similar to FIG. 41 but illustrating still another embodiment of the invention as made by the apparatus of FIG. 52.
FIG. 54 is a section along the line LIV—LIV of FIG. 53.
FIG. 55 is a cross-sectional view taken along the line LV—LV of FIG. 53.
FIG. 56 is an enlarged view of one of the shanks of FIG. 53.
FIG. 58 is a cross-sectional view taken along the line LVIII—LVIII of FIG. 53.

FIG. 52 shows an apparatus for flattening the continuous strands of the synthetic-resin monofilament before they are advanced into the loom in which they are woven into the tape-like units. The stranding material for the fabrication of the coupling rows according to the invention are circular-cross section stretched synthetic-resin monofilaments which are drawn from supply spools 413 and are stretched with a ratio as described. The monofilaments 418 are woven into the respective slide fastener halves as described above.

I claim:

1. A process for producing a slide fastener comprising the steps of:

forming successive sheds of a pair of parallel groups of warp threads;

laying a pair of synthetic-resin monofilaments into the respective sheds of said groups from opposite sides thereof as respective double wefts bending said monofilaments alternately around a common mandrel to form interlocking eyes between said groups of warp threads; and beating up the double wefts formed by said synthetic-resin monofilaments to constitute thereof mutually abutting pairs of shanks extending from each eye and forming coupling elements therewith whereby each pair of shanks is tightly held in a pocket of the warp threads extending transversely thereof.

2. In a method of making a slide fastener which comprises the steps of:

(a) rolling a circular cross-section synthetic-resin monofilament to impart an ellipsoidal configuration to the resulting rolled strand;

(b) buckling said strand to form a coupling head and a coupling eye with the major axis of the cross-section of said strand in the region of said eye extending in the longitudinal direction of the slide fastener;

(c) twisting the strand through 90° laying down a shank connected to said eye;

(d) bending said strand to form a bight with the major axis of the cross-section of said strand in the region of said bight being perpendicular to said plane;

(e) twisting said strand through 90° and depositing another shank running away from said bight;

(f) repeating steps (b)–(e) to form a succession of coupling elements from said strand; and (g) thermofixing said coupling elements.

3. The improvement defined in claim 2 wherein said monofilament is rolled cold.

4. The improvement defined in claim 3 wherein the major and minor axes of the cross-section of the strand are modified from 10 to 25% during thermofixing.

5. The improvement defined in claim 2 wherein the thermofixing is carried out by the application of heat.

6. The improvement defined in claim 2 wherein the thermofixing is carried out by the application of ultrasonic energy.

7. The improvement defined in claim 2 wherein said strand is a stretched polyester or polyamide filament having a stretch ratio of 1:3.5 to 1:5.

8. The improvement defined in claim 2 wherein said shanks are laid down as a weft of a tape-like unit and are interwoven with warp threads in respective warp sheds.

9. The improvement defined in claim 2, further comprising the step of looping a weft thread around the strand during the formation of coupling elements thereby.

10. A loom for producing a slide fastener, comprising:

heddle means for forming a shed of a group of textile warp threads;

a forming mandrel along one side of said group of warp threads;

a weft needle swingable into and out of the sheds from the opposite side of said group for looping a synthetic-resin monofilament around said mandrel and depositing said monofilament as a double weft all across said group in each shed;

means for beating up the weft formed by said monofilament;

means for raising and lowering said mandrel to enable said monofilament to be passed therearound;

another group of warp threads disposed parallel to the first-mentioned group whereby said mandrel lies between said groups; and a further weft needle for laying in another synthetic-resin monofilament and passing same around said mandrel alternately with the loops of the first-mentioned monofilament formed therearound.

11. The loom defined in claim 10 wherein said means for raising and lowering said mandrel comprises a mandrel holder, plunger means engageable with said mandrel holder from above and below, and means for releasable retaining said holder in upper and lower positions.

12. The loom defined in claim 11 wherein said retaining means comprises magnets.

13. The loom defined in claim 10, further comprising thermofixing means at said mandrel for thermofixing said coupling elements.

14. The loom defined in claim 10, further comprising means for alternately forming direct bights interconnecting each coupling head with one of the coupling heads adjacent thereto without intervening shanks and remote bights interconnecting respective heads with shanks spanning a plurality of said warp threads.

* * * * *